US007494309B2

(12) United States Patent
Khattab et al.

(10) Patent No.: US 7,494,309 B2
(45) Date of Patent: Feb. 24, 2009

(54) CROSS MEMBER WITH CONTAINER STOP

(75) Inventors: Mohammed A. Khattab, Burlington (CA); James W. Forbes, Campbellville (CA); Ilario A. Coslovi, Burlington (CA); Tomasz Bis, Hamilton (CA)

(73) Assignee: National Steel Car Limited (CA)

( * ) Notice: Subject to any disclaimer, the term of this patent is extended or adjusted under 35 U.S.C. 154(b) by 327 days.

(21) Appl. No.: 11/081,008

(22) Filed: Mar. 15, 2005

(65) Prior Publication Data

US 2006/0008337 A1 Jan. 12, 2006

Related U.S. Application Data

(60) Continuation of application No. 09/965,670, filed on Sep. 27, 2001, now Pat. No. 6,866,452, which is a continuation-in-part of application No. 09/443,533, filed on Nov. 19, 1999, now Pat. No. 6,354,778, which is a division of application No. 08/920,548, filed on Aug. 29, 1997, now Pat. No. 6,003,445.

(51) Int. Cl.
*B60P 7/08* (2006.01)

(52) U.S. Cl. ..... 410/94; 410/69; 410/70; 410/72

(58) Field of Classification Search ..... 410/94, 410/69, 54, 70, 72, 73, 76, 121, 95; 105/355, 105/404, 419
See application file for complete search history.

(56) References Cited

U.S. PATENT DOCUMENTS 512,233 A 1/1894 Speed
1,201,689 A 10/1916 Burnett
1,562,939 A 11/1925 Burns (Continued)

FOREIGN PATENT DOCUMENTS

CA 719883 1/1965

(Continued)

OTHER PUBLICATIONS

Husky Stack 2+2, Greenbrier Intermodal, Gunderson, Inc., no date.

*Primary Examiner*—Stephen Gordon
(74) *Attorney, Agent, or Firm*—Hahn Loeser & Parks LLP; Michael H. Minns

(57) ABSTRACT

A well car for carrying shipping containers has a pair of end structures supported by rail car trucks, a pair of first and second spaced apart side beams extending between the end structures and a well defined therebetween. A container support cross member is mounted between the side beams in a position to support an end of a shipping container load carried within the well. The container support cross member includes a monolithic beam member with a attachment fitting formed at an end thereof. The attachment fitting is connected to a side beam at a moment connection. The remaining end of the cross member is similarly configured and connected to the second side beam. Each end of the cross member has load bearing surface portions which may be used for supporting a corner of a shipping container. The moment connections permit a bending moment to be carried by the cross member between the first and second side beams. A retractable container stop is mounted to each end of the central container support cross member.

28 Claims, 22 Drawing Sheets

U.S. PATENT DOCUMENTS 1,696,332 A 12/1928 Sheehan
1,715,765 A 6/1929 Kobayashi
1,845,594 A 2/1932 Fildes
1,988,651 A 1/1935 Fildes
2,053,500 A 9/1936 Sillcox
2,079,747 A 5/1937 Mussey et al.
2,094,442 A 9/1937 Blomberg
2,114,707 A 4/1938 Fitch et al.
2,183,303 A 12/1939 Campbell
2,841,447 A 7/1958 Cotter
3,042,456 A 7/1962 Alfieri
3,144,838 A 8/1964 Shaver et al.
3,319,583 A 5/1967 Gutridge
3,357,371 A 12/1967 Gutridge
3,389,663 A 6/1968 Gutridge
3,410,227 A 11/1968 Gutridge
3,415,205 A 12/1968 Gutridge
3,444,824 A 5/1969 Gutridge
3,493,210 A 2/1970 Brenner
3,520,256 A 7/1970 Gutridge
3,552,325 A 1/1971 Enochian
3,561,369 A 2/1971 O'Leary
3,577,933 A 5/1971 Ferris
3,774,551 A 11/1973 Sweger
4,091,741 A 5/1978 Hartkorn
4,091,742 A 5/1978 Cordani
4,331,083 A 5/1982 Landregan et al.
4,456,413 A 6/1984 Pavlick
4,465,670 A 8/1984 Sugisaki et al.
4,543,887 A 10/1985 Baker
4,589,348 A 5/1986 Holabeck et al.
4,599,949 A 7/1986 Hill
4,624,188 A 11/1986 Kaleta
4,648,764 A 3/1987 Pavlick
4,686,907 A 8/1987 Woollam et al.
4,703,699 A 11/1987 Hill
4,718,353 A 1/1988 Schuller et al.
4,750,431 A 6/1988 Yates et al.
4,754,709 A 7/1988 Gramse et al.
4,759,294 A 7/1988 Schuller et al.
4,771,706 A 9/1988 Lindauer et al.
4,776,736 A 10/1988 Tatina
4,782,762 A 11/1988 Johnstone et al.
4,784,548 A 11/1988 Butcher et al.
4,802,420 A 2/1989 Butcher et al.
4,805,539 A 2/1989 Ferris et al.
4,807,722 A 2/1989 Jamrozy et al.
4,826,371 A 5/1989 Brown
4,841,876 A 6/1989 Gramse et al.
4,854,791 A 8/1989 Brown
4,862,810 A 9/1989 Jamrozy et al.
4,867,622 A 9/1989 Brown
4,876,968 A 10/1989 Lindauer et al.
4,889,055 A 12/1989 Jamrozy et al.
4,893,567 A 1/1990 Hill et al.
4,905,608 A 3/1990 Terlecky et al.
4,909,157 A 3/1990 Jamrozy et al.
4,911,082 A 3/1990 Richmond
4,925,349 A 5/1990 Yurgevich
4,930,426 A 6/1990 Saxton et al.
4,951,575 A 8/1990 Dominguez et al.
5,000,633 A 3/1991 Kowalik et al.
5,017,066 A 5/1991 Tylisz et al.
5,020,947 A 6/1991 Marcelius
5,052,868 A 10/1991 Hesch et al.
5,054,403 A 10/1991 Hill et al.
5,085,152 A 2/1992 Tylisz et al.
5,106,247 A 4/1992 Hove et al.
5,170,718 A 12/1992 Hill et al.
5,216,285 A 6/1993 Hilsenteger et al.
5,246,321 A 9/1993 Hesch
5,279,230 A 1/1994 Thomas et al.
5,308,202 A 5/1994 Tatina
5,423,269 A 6/1995 Saxton et al.
5,465,670 A 11/1995 Butcher
5,501,556 A 3/1996 Burcher et al.
5,520,489 A 5/1996 Butcher et al.
5,613,814 A 3/1997 Jackson
5,730,063 A 3/1998 Forbes et al.
5,743,191 A 4/1998 Coslovi
5,749,686 A 5/1998 Butcher et al.
5,785,473 A 7/1998 Stark
5,842,821 A 12/1998 Coslovi et al.
6,003,445 A * 12/1999 Coslovi et al.
6,196,137 B1 3/2001 Forbes
6,241,439 B1 6/2001 Weber
6,309,153 B1 10/2001 Petzitillo et al.
6,354,778 B1 3/2002 Coslovi et al.
6,505,564 B2 1/2003 Khattab
6,866,452 B2 * 3/2005 Khattab et al. ..... 410/94

FOREIGN PATENT DOCUMENTS

CA 1235335 4/1988
CA 1261203 9/1989
CA 2094194 5/1994
CA 2146709 10/1995
CA 2175440 10/1997
CA 2175445 10/1997

* cited by examiner

CROSS MEMBER WITH CONTAINER STOP

This application is a continuation of application Ser. No. 09/965,670 filed on Sep. 27, 2001 and issued Mar. 15, 2005 as U.S. Pat. No. 6,866,452, which is a continuation-in-part of application Ser. No. 09/443,533 filed on Nov. 19, 1999 and issued Mar. 12, 2002 as U.S. Pat. No. 6,354,778, which is a division of application Ser. No. 08/920,548 filed on Aug. 29, 1997 issued Dec. 21, 1999 as U.S. Pat. No. 6,003,445.

FIELD OF THE INVENTION

The present invention relates generally to the field of railroad cars for carrying intermodal cargo containers.

BACKGROUND OF THE INVENTION

Railway well cars may be conceptualised as having a pair of deep, spaced apart, parallel beams, with floor members extending cross-wise between the beams to form a support frame for lading. The ends of the deep beams are mounted to end structures, and the end structures are supported on a pair of railcar trucks. Although single unit well cars are still common, there has been a trend in recent years toward articulated, multi-unit railcars that permit a relatively larger load to be carried on fewer railcar trucks. The cross section of the car is generally defined by the pair of spaced apart left and right hand deep side beams, and structure between the side sills of the side beams to support such lading as may be placed in the well. Typically the floor, or lading support structure, in the well includes diagonally oriented members to carry shear between the side sills under lateral loading conditions.

Contemporary well cars may carry a number of alternative loads made up of containers in International Organization for Standardization (ISO) sizes or domestic sizes, and of highway trailers. The ISO containers are 8'-0" wide, 8'-6" high, and come in a 20'-0" length weighing up to 52,900 lbs., or a 40'-0" length weighing up to 67,200 lbs. Domestic containers are 8'-6" wide and 9'-6" high. Their standard lengths are 45', 48' and 53'. All domestic containers have a maximum weight of 67,200 lbs. Recently 28' long domestic containers have been introduced in North America. They are generally used for courier services which have lower lading densities. The 28' containers have a maximum weight of 35,000 lbs.

Whichever the case may be, a well car is required to withstand three kinds of loads. First, it must withstand longitudinal draft and buff loads inherent in pulling or pushing a train, particularly those loads that occur during slack run-ins and run-outs on downgrades and upgrades. Other variations of the longitudinal load are the 1,000,000 lbs., squeeze load and the 1,250,000 lbs., single-ended impact load. Second, the well car must support a vertical load due to the shipping containers it carries. Third, it must be able to withstand lateral loading as the well car travels along curves and switch turn-offs.

For example, in an earlier well car, as shown in U.S. Pat. No. 4,893,567 of Hill et al., issued Jan. 16, 1990, the structure between the side sills includes lateral cross members. The ends of the cross members are mounted to longitudinally extending side sills. The cross members are indirectly attached to the side sills via hinged fittings which, in turn, are attached to the side sills. The hinge connection may tend to permit some flexing of the structure under some loads, while still providing a connection conceptually analogous to a pin joint for resistance to lateral deflection.

Longitudinal compressive loads imposed on the well car are transmitted into the car at the draft gear stops; carried outboard in the end structures through the end shear plate, sills and bolsters to the side beams; and then along the top and bottom chords to the other end of the car. The combined compressive longitudinal loads alone, or in combination with the effect of the vertical container loads tend to urge the top chords to buckle. Typically under compressive loading the top chords of the side beams tend to move laterally inboard relative to the bottom chords.

One way to address this tendency is to employ top chords of heavier section and high polar moment of inertia. This may tend to increase the weight of the side beams. It is generally desirable to avoid increasing the weight of rail road cars, since an increase in weight implies an increase in cost of material for fabrication, increased running costs when the car is empty, and a reduced maximum lading capacity since the loaded weight of the car plus lading must not exceed a given limit, whether 263,000 lbs., 286,000 lbs., or 315,000 lbs., as may govern the service for which the car is intended. For these reasons, it is generally preferable to use a lesser weight of metal more efficiently.

The inward deflection of the top chords of the side beams under buckling loads (as suggested by the intermittently dashed lines exaggeratedly representing deflection, the top chord deflection being signified by 'δ' in FIG. 4*a*), can be resisted to some extent by providing an opposing spring mechanism. To that end, it is desirable to employ a continuous cross member from side to side, and side posts connecting the top and bottom chords. The attachment to the side beams is conceptually similar to that of a built-in end condition. That is, a built-in end condition occurs where the connection joint will not only carry a shear load, but will, in addition, transmit a bending moment. If the cross-member transmits moments at connections to both side sills, and assuming that the cross-member is of significant section relative to the side sills, then twisting of the side beams will tend to impose a bending load in the cross member. As the car is symmetrical, this moment may tend to be resisted by an equal and opposite moment arising in the other half of the car, as suggested by moment 'M', in FIG. 4*a*. When this occurs the cross member, and the other members in the load path, such as the side posts, co-operate to act as a spring assembly tending to resist the top chord deflection (buckling), and side beam twisting.

The floor structure of a container carrying well car may typically include lading bearing cross-members: (a) at the ends of the well in the 40 foot container pedestal positions, and (b) in the middle of the well in the form of a central cross member to support containers at the 20 foot position. These vertical load bearing cross-members support the shipping container corners. The floor structure may also include several intermediate cross-members, and diagonals. The intermediate cross-members and diagonal members are conceptually like the members of a pin-jointed truss and are provided to aid in resistance to lateral loads, as opposed to bearing the vertical load of the containers. Consequently, inasmuch as these additional cross-members perform a different function, they tend to be of significantly reduced section relative to the container bearing cross-members.

In at least one earlier car, the connection of the floor cross-members and diagonal members to the side sills has been the source of fatigue cracking concerns. When the cross-members are welded in place, it is not uncommon for portions of the weld to be placed in repeated, cyclic loading during operation. Inasmuch as it is sometimes difficult to obtain consistent, defect-free welds, defects in the welds can provide fatigue crack initiation sites.

Use of hinges may tend to reduce the probability of fatigue crack initiation due to cyclic flexing in bending, since hinges do not transmit a bending moment. However, a hinged cross-member may also not tend to function to resist the lateral flexing of the side sills particularly well. A bolted connection may be preferable to a welded connection, since it avoids the possibility of weld defects and high level of stress concentration due to geometric nonlinearities.

Other cross member assemblies, for example, as shown in U.S. Pat. No. 5,465,670 of Butcher, issued Nov. 14, 1995, similarly have connections to the side sills in the horizontal plane only. U.S. Pat. No. 5,465,670 shows a three part main cross member assembly having a linear section matingly engaged with a mounting bracket at either end. The mounting bracket is welded to the linear section and then attached to a horizontal leg of a side sill. Both the main cross members and corresponding single piece intermediate cross members have hollow rectangular cross-sections. No additional reinforcement is provided at the ends of either cross member where shear forces caused by lading are greatest.

The use of a the three-part cross-member at either the central, 20 foot container position at mid-span in the well between the rail car trucks, or at the 40 foot container pedestal positions as shown by Butcher, may also have disadvantages. Container support castings are connected to either end of an intermediate cross member at a pair of peripheral welds respectively. These welded joints are labour intensive and may require full ultrasonic (UT) inspection. In service, the welds may be subjected to relatively severe cyclic loading. Flaws in such welded joints may tend to become fatigue crack initiation sites when subjected to cyclic loading. It would be advantageous to employ a cross-member at a container support position, whether at the 20 or 40 foot location, that tends not to expose a welded joint to cyclic loading. It would be most preferable to employ a forged (that is, hot or cold formed), one-piece monolithic beam that under-hangs the well from side sill to side sill.

During transport of intermodal cargo containers, lateral and longitudinal forces also act upon cargo containers carried within the rail car. These forces may be generated during switching operations and other car or train handling procedures. Typically, cargo containers tend not to be secured to the cross-members or to any other element of the rail car structure. Such containers may rest on container supports, which may have guide blocks and locating cones welded thereto. A typical container support is illustrated in U.S. Pat. No. 5,501,556, issued to Butcher et al. on Mar. 26, 1996. The locating cones may each be received by a corresponding structural member of a container placed thereon, and the guide block may be employed to align the container with the locating cone. Container supports are conventionally located at the 40-foot corner locations of the well car floor. Aside from the container support, there is typically little else to inhibit longitudinal movement of a container placed within the well.

When a second row of cargo containers is stacked onto a first row of containers in the well of a rail car ("double-stacking"), the top row of containers may be secured to the bottom row of containers with connecting devices such as inter-box connectors. These connectors join the upper four corners of the bottom row of containers to the lower four corners of the top row of containers, and may inhibit movement of the containers. The lateral and longitudinal forces which act upon cargo containers during transport may result in the displacement or shifting of a container from an initial location in the container well to some other position. Where a container is loaded into an empty well car and the length of the well portion of the rail car exceeds the length of the container placed therein, longitudinal shifting of the container within the well may occur.

When a single long container, such as a 40 foot container, is stacked over two 20-foot containers, container pitching from longitudinal impact may be limited because the long container may tend to stabilize the two lower containers. As a result, the lower 20-foot containers may be inhibited from pitching or lifting from the container support, or both, as for example when the rail car is subject to longitudinal forces, such as in an end impact. However, if 20-foot containers are double-stacked, the relatively high center of gravity of the containers, combined with their shorter 20-foot length, may lead to greater pitching of the containers, and one or more of the containers may become displaced from one or more of the container supports when the rail car is subject to longitudinal forces. This may increase the possibility that one or more of the containers will become disengaged from at least one of its associated locator cones, and slide into adjacent containers.

To alleviate this problem, a number of manually operable container stops exist which may be located centrally within the railcar well, and which are intended to prevent the longitudinal displacement or shifting of 20-foot containers in the well of the car. One such manually operable container stop is disclosed in U.S. Pat. No. 5,465,670, issued on Nov. 14, 1995 in the name of Butcher. A pivotable container stop is disclosed in Canadian application Ser. No. 2,175,445 filed on Apr. 30, 1996 in the names of Butcher and Coslovi. For these container stops, an operator typically must manually activate the stop by unlocking a mechanism in the railcar sidewall to allow the stop to pivot into the well of the car. When so disposed, the stop prevents the longitudinal displacement or shifting of 20-foot containers within the well. If it is desired to employ the well of the railcar for a 40-foot container, the manually operable stops generally tend to require manual retraction by an operator who pivotally moves the stop out of the well portion of the railcar and into a retracted position within the railcar sidewall. Otherwise, the container stops might possibly interfere with loading of larger containers such as 40-foot or 48-foot containers.

An alternative rail car cross-member that may conveniently inhibit longitudinal movement of cargo containers, while being capable of transmitting a bending moment without exposing a welded joint to cyclic loading, is desirable.

SUMMARY OF THE INVENTION

In an aspect of the invention there is a cross member for a rail road well car for carrying shipping containers. The cross-member comprises a monolithic beam member having a first end portion for mounting to a first side beam of the well car, a second end portion for mounting to a second side beam of the well car, and a spanning portion extending between the first and second end portions. A retractable container stop is mounted to the first end.

In an additional feature of that aspect of the invention, a second retractable container stop is mounted to the second end portion. In another additional feature, the container stop is biased to an extended position for obstructing passage of containers therepast. In yet another additional feature, each of the container stops is biased to an extended position for obstructing passage of containers therepast. In still another additional feature, the first end of the cross-member has a socket formed therein, and the retractable container stop is mounted in the socket.

In still yet another additional feature, the cross-member is wider adjacent the retractable container stop than amidst the spanning portion. In a further additional feature, the first end portion has an upwardly facing load bearing surface extending longitudinally to either side of the retractable container stop. The container stop is movable to a retracted position under the vertical load of a container, and, in the retracted position, the stop permits shifting of containers relative thereto.

In yet a further additional feature, the first end portion has a load bearing surface, and the stop is movable to a retracted position. The retracted position is chosen from the set of retracted positions consisting of a position that is flush with the load bearing surface and a position that is shy of the load bearing surface. In still a further additional feature, the stop is a round cylindrical stop. The first end has a bore formed therein, and the round cylindrical stop is matingly engaged in the bore.

In another additional feature, the stop has planar abutment surfaces for installation facing longitudinally forward and rearward relative to the well car. The first end has a bore formed therein for mating engagement of the stop. In still another additional feature, the first and second end portions each have a toe bent to form an upstanding flange. In yet another additional feature, each of the first and second end portions have mounting fittings formed in the upstanding flange. In still yet another additional feature, each of the first and second end portions has a horizontal portion, and fittings formed in the horizontal portion for attaching the horizontal portion to a horizontal portion of the respective side beams of the rail road car.

In a further additional feature, the spanning portion has a first vertical through thickness. The first end portion has a second vertical through thickness. The second vertical through thickness is smaller than the first vertical through thickness. In yet a further additional feature, the first end portion includes a toe bent upwardly to form an upstanding flange. The flange is machined to have a diminishing thickness. In still yet a further additional feature, the cross member has at least one lightening aperture formed therein. In still another additional feature, the cross member is wider adjacent the retractable stop than amidst the spanning portion. In yet another additional feature, the cross member tapers from a narrow waist amidst the spanning portion to a broad land adjacent the retractable coil stop. The lightening aperture terminates short of the broad land.

In still yet another additional feature, the first end has a bore formed therethrough to define a socket. The retractable stop includes a block seated in the socket. The block is reciprocally movable in an upward direction relative to the socket. A retainer is mounted under the first end portion. A biasing member is captured between the block and the retainer. In still another additional feature, the first end has a bore formed therein to define a socket. The retractable stop includes a block having a blind bore formed therein and a biasing member having a first end engaged in the blind bore and a second end extending therefrom. The first end portion has an underside. A retainer is mounted to the underside. The block is mounted to reciprocate at least predominantly vertically in the bore. The second end of the biasing member bears against the retainer.

In another aspect of the invention there is a cross member for a rail road well car. The well car has a longitudinal rolling direction. The cross member comprises a monolithic beam member having a first end portion, a second end portion, and a spanning portion extending between the first and second end portions. The end portions have respective mounting fittings by which to connect the end portions to longitudinally extending side beams of the well car. Each of the end portions have an upwardly facing surface region for supporting intermodal container loads. A stop is mounted to the first end portion. The upwardly facing surface of the first end portion has portions extending longitudinally to either side of the stop. The stop is movable to a retracted position under the vertical load of a cargo container, and, in the retracted position, the stop permits longitudinal shifting of a container relative thereto. The stop is biased to an extended position, and, in the extended position, the stop stands in the way of shifting of a container from either longitudinal side past the stop.

In an additional feature of that aspect of the invention, the stop is a first stop. The cross member has a second stop mounted to the second end portion thereof. The upwardly facing surface of the second end portion has portions extending longitudinally to either side of the second stop. The second stop is movable to a retracted position under the vertical load of a cargo container, and, in the retracted position, the second stop permits longitudinal shifting of a container relative thereto. The second stop is biased to an extended position, and, in the extended position, the stop stands in the way of shifting of a container from either longitudinal side therepast.

In another aspect of the invention there is a rail road well car comprising a rail road car body carried by railcar trucks for rolling motion in a longitudinal direction. The rail-car body has first and second spaced apart end structures and a pair of first and second spaced apart longitudinally extending side beams mounted between the end structures. The end structures and side beams co-operate to define a well therebetween. The well has a first end adjacent the first end structure, and a second end adjacent the second end structure. Each of the side beams includes a top chord, a bottom chord, and a sidewall extending between the top and bottom chords. The well car has a first transverse member for supporting a cargo container, mounted between the bottom chord of the first side beam and the bottom chord of the second side beam, adjacent the first end of the well. The well car has a second transverse member for supporting a cargo container, mounted between the bottom chord of the first side beam and the bottom chord of the second side beam, adjacent the second end of the well. The well car has a third transverse member for supporting a cargo container, mounted between the bottom chord of the first side beam and the bottom chord of the second side beam at a location intermediate the first and second transverse members. The third transverse member includes a monolithic beam member having a first end portion mounted to the first side beam, a second end portion mounted to the second side beam, and a spanning portion extending between the first and second end portions thereof. A retractable container stop is mounted to each of the first and second end portions of the third transverse member. Each container stop is moveable to a retracted position under a vertical load of a cargo container. In the retracted position, the stop permits longitudinal shifting of the container upon the third transverse member longitudinally to either side of the container stop. Each container stop is biased to an extended position. In the extended position of the container stop, the container stop stands proud of the third transverse member to prevent shifting of a container from either longitudinal side past the stop.

In an additional feature of that aspect of the invention, the third transverse member has a surface upon which an intermodal container can sit. Each stop has a top, and, in the retracted position, the top lies flush with the surface.

In another additional feature, the first and second end portions of the third transverse member include toes formed to mate with the adjacent side structures of the well car. Each end portion has an upwardly facing surface for supporting the intermodal container. Each end portion has a recess defined therein amidst the horizontal surface. Each stop has a top. In the retracted position the top lies flush with the upwardly facing surface.

In yet another additional feature, each of the bottom chords has an upwardly extending leg adjoining the sidewall of the first and second side beams respectively. Each of the bottom chords has a transverse leg. The transverse legs extend toward each other. Each of the first and second end portions of the third transverse member has a horizontally extending portion. The horizontally extending portion has bores formed therein to permit the horizontally extending portion to be bolted to the transversely extending leg of a respective one of the bottom chords. Each of the first and second end portions of the third transverse member has an upwardly extending flange adjacent the upwardly extending leg of the respective bottom chord. The upwardly extending flanges have bores defined therein to permit each of the upwardly extending flanges to be bolted to a respective one of the first and second side structures.

In still another additional feature, each of the first and second end portions of the third transverse member has an upwardly facing surface for supporting a shipping container and a recess formed amidst the upwardly facing surface. The stop is mounted in the recess. The surface has a first portion longitudinally to one side of the recess and a second portion longitudinally to another side of the recess.

In still yet another additional feature, each of the bottom chords has a transversely inwardly extending leg, and the transversely inwardly extending leg has a relief formed therein adjacent to the third transverse cross member.

In a further additional feature, each of the bottom chords has a transversely inwardly extending leg. The transversely inwardly extending legs extend toward each other and leave a gap therebetween that is less than 8'0" wide. The bottom chords meet the first and second end portions of the third cross member at respective first and second junctions. The transversely inwardly extending legs of the bottom chords are locally relieved adjacent the first and second junctions. In still yet a further additional feature, the third transverse member has a socket formed in each of the first and second end portions. The retractable container stops are mounted in the sockets. The third transverse member has an underside. Stop retainers are mounted to the underside of the third transverse member. The retainers are mounted within the reliefs of the bottom chord.

In another aspect of the invention there is a rail road well car comprising a car body supported on railcar trucks for rolling motion in a longitudinal direction along rail road tracks. The railcar body has a pair of spaced apart end structures and a pair of longitudinally extending spaced apart side beams extending between the end structures. The end structures and the side beams define a well therebetween. Each of the side beams has respective first and second bottom chord members. The bottom chord members each have a leg extending transversely inward relative to the well. At least a first transverse member has a first end mounted to the first bottom chord member at the first junction, and a second end mounted to the second bottom chord member at a second junction. The legs of the bottom chord portion have a width, and the legs have a portion of diminished width adjacent to the first and second junctions.

DETAILED DESCRIPTION OF THE INVENTION

In terms of general orientation and directional nomenclature, for the rail road car described herein, the longitudinal direction is defined as being coincident with the rolling direction of the car, or car unit, when located on tangent (that is, straight) track. The longitudinal direction is parallel to the side beams. Unless otherwise noted, vertical, or upward and downward, are terms that use top of rail TOR as a datum. The term "lateral," or "transversely" or "laterally outboard," refers to a distance or orientation relative to the longitudinal centerline of the railroad car, or car unit, indicated as CL—Rail Car. The term "longitudinally inboard", or "longitudinally outboard" is a distance taken relative to a mid-span lateral section of the car, or car unit.

Figure 1A:
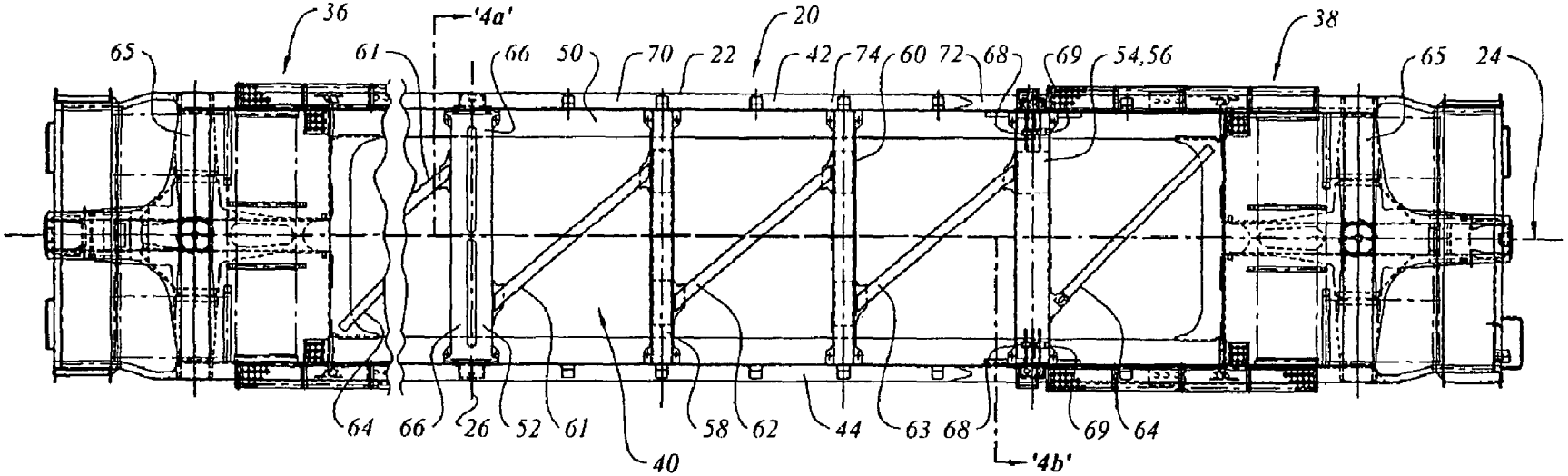
FIG. 1*a* shows a shortened top view of a rail road car of the present invention.
Figure 1B:
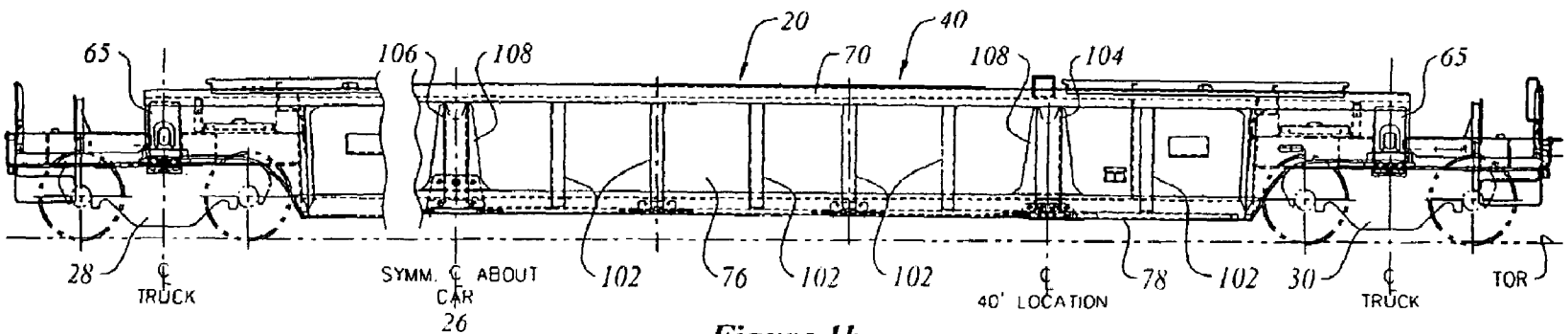
FIG. 1*b* shows a side view of a rail road car of FIG. 1*a;*

FIGS. 1*a* and 1*b* show a rail road car in the nature of a well car, indicated generally as 20. Other than as specifically indicated, the major structural elements of car 20 are symmetrical about the longitudinal axis of the car and also about the mid-span transverse axis. Rail road car 20 has a rail car body 22 supported upon a pair of rail car trucks 28 and 30, for rolling motion in the longitudinal direction (i.e., along the rails). A longitudinal vertical plane of symmetry running along the longitudinal centerline of car 20 is indicated as 24. A transverse plane of symmetry at mid-span between trucks 28 and 30 is identified as 26.

Rail car body 22 includes a pair of first and second, spaced apart end structures 36, 38 each mounted over a respective one of rail car trucks 28, 30; and a pair of opposed, spaced apart, parallel first and second, longitudinally extending, deep side beam assemblies in the nature of left and right hand longitudinally extending side beams 42, 44. Side beams 42, 44 are mounted to extend between end structures 36, 38. A well 40 is defined longitudinally between end structures 36, 38. Side beams 42 and 44 define sides of well 40.

A floor assembly 50, includes a first structural cross member in the nature of a main central container support cross beam also identified as center cross member 52, in the mid-span position that extends perpendicular to, and between side beams 42, 44; a pair of first and second end structural cross members in the nature of container support end cross beams or cross members 54 and 56 located at the "40 foot" locations, roughly 20 feet to either side (in the longitudinal direction of car 20) of main cross beam 52; intermediate structural cross members, or struts in the nature of intermediate cross-ties 58, 60; and diagonal cross braces 61, 62, 63, and 64. Diagonal cross braces 61 to 64 co-operate with beams 52, 54, 56 and cross-ties 58, 60 to act as a shear transferring assembly, or web work structure, mounted between side beams 42, 44, for resistance to lateral loading of the car, as in cornering. The construction of cross beams 52, 54 and 56 which join side beam 42 to side beam 44, is described in greater detail below.

Within the allowance for longitudinal camber of car 20 generally, all cross members 52, 54, 56, 58 and 60 are preferably parallel to, and generally coplanar with, one another. When installed, center member 52 may be marginally higher than the other cross members 54, 56 and cross-ties 58 and 60. This nevertheless may still tend to permit the relatively level loading of intermodal cargo containers which are raised at one end by container locating cones 68 located on end cross beams 54 and 56.

Cargo loads, such as intermodal cargo containers or other types of shipping containers carried by rail car 20, are intended to be supported primarily, if not entirely, by cross members 52, 54 and 56. That is, it is not intended that the vertical container loads due to gravity should be borne by either intermediate cross-ties 58, 60 or by diagonal braces 61 to 64. Container supports or container locating cones 68 are located on end cross members 54 and 56. Cones 68 help to locate a container relative to cross-members 54 and 56. The cross members 52, 54 and 56 are located so that the well 40 can accommodate either two 20 foot containers, each with one end located on cones 68 and the other end resting on the center cross member 52, or a single 40 to 53 foot container, also located on cones 68 at either end.

End cross members 54 and 56 may also include container guides 69, which are preferably located adjacent cones 68. Guides 69 to help locate a container relative to cross members 54 and 56. Container guide 69 may be employed to guide the container longitudinally during loading thereof into well 40 and onto a corresponding locating cone 68.

When supporting two 20 foot containers, an end of each container is supported by cross member 52. To accommodate these two container ends, cross member 52 is provided with load bearing portions, such as surface 66, of sufficient breadth to accommodate corner fittings of ends of two adjacent 20 foot shipping containers at the same time. That is, cross member 52 has a width at least as great as twice the width of the container corner fitting foot print plus an allowance for spacing between two adjacent containers carried back-to-back in the well. That is, width W is at least as great as 15 inches, and is preferably 17½ inches, or more than 17½ inches. As such, the center cross member 52 carries approximately half of the load in this configuration. The weight supported by cross member 52 may be further increased if more than one level of cargo container is carried, such as when two containers are stacked on one another.

Description of Side Beams

Figure 2:
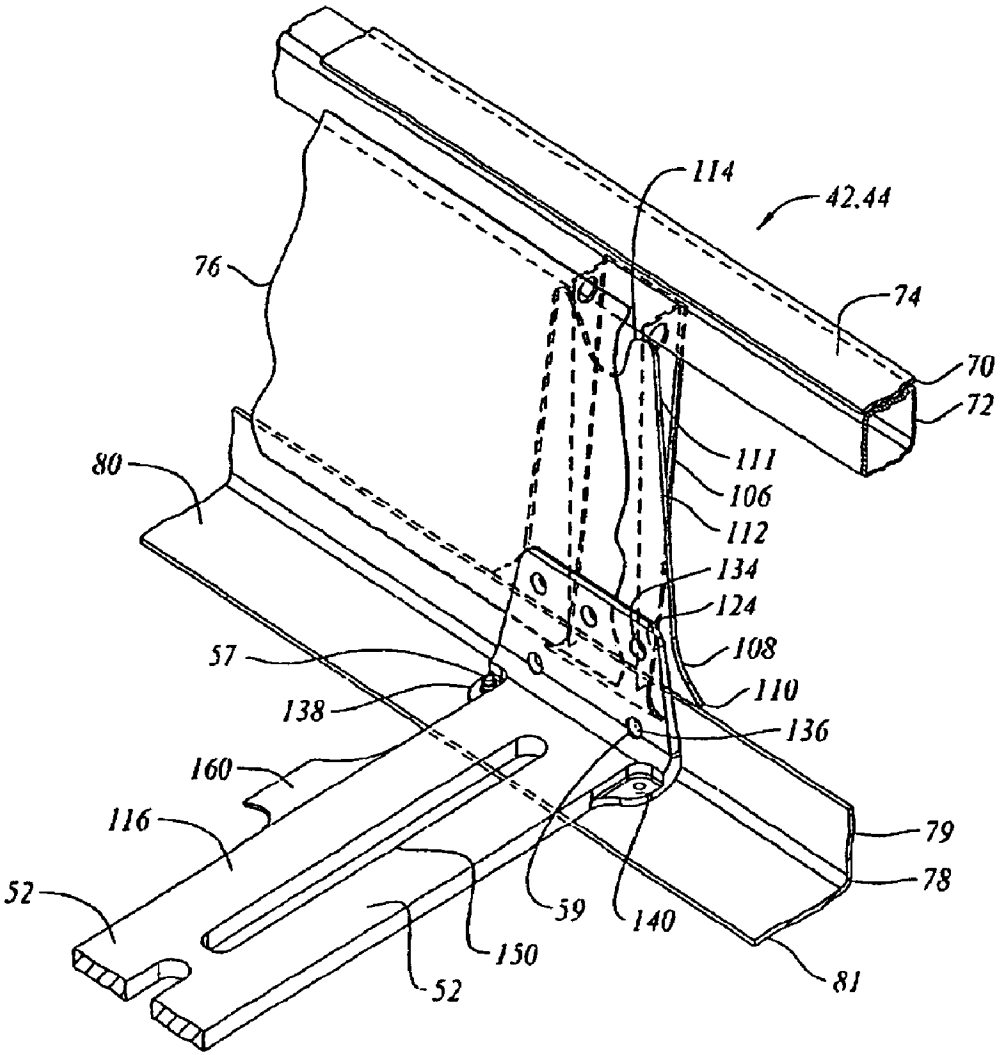
FIG. 2 shows a partial perspective view of the rail road car of FIG. 1*a* showing center cross beam connected to a side of said rail road car.
Figure 3:
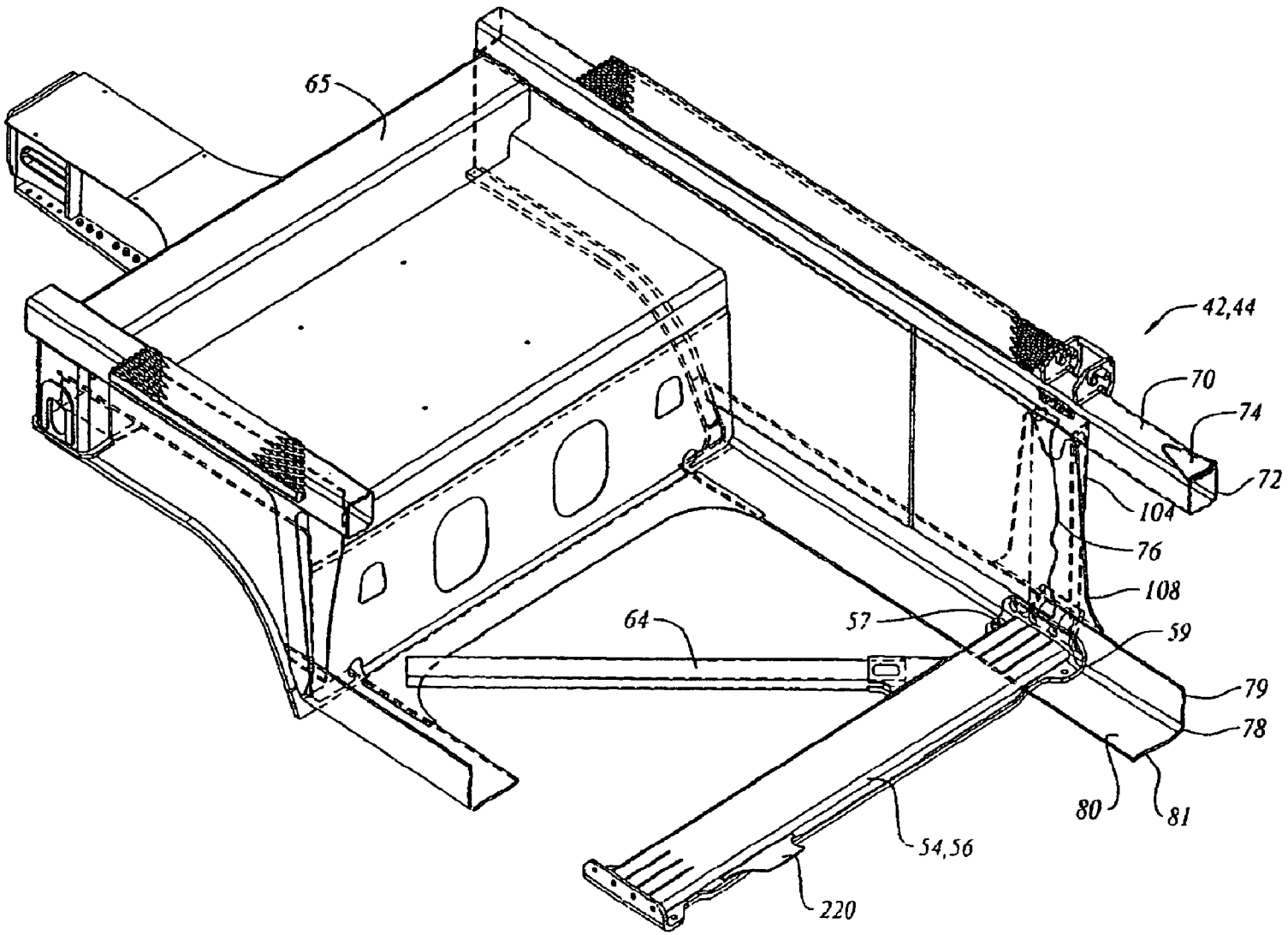
FIG. 3 shows a partial perspective view of the rail road car of FIG. 1*a* showing an end cross member and a diagonal strut connected to a side of said rail road car.

For the purposes of this description, the structure of one side beam is the same as the structure of the other side beam. Consequently a description of one side beam will serve also to describe the other. Referring to FIGS. 2, 3, and 4, the assembly of side beam 42 has an upper longitudinally extending structure member in the nature of a top chord member 70 in the form of a four-sided hollow tube 72. A top chord doubler plate 74, of significant thickness (1" is preferred), is welded to the upper wall, or flange, of tube 72 and runs about 35 feet along the central portion of top chord member 70 corresponding to the region of highest bending moment. In the preferred embodiment hollow tube 72 is a steel tube of square cross-section. A shear transfer member in the nature of a side sheet identified as web 76 is attached by a lap weld to, and extends downwardly from, the inner (i.e. laterally inboard) face of hollow tube 72. At its lower edge, web 76 is welded to a lower, longitudinally extending structural member in the nature of a side sill, namely bottom chord 78, preferably in the form of heavy angle 80. Bottom chord 78 has an upwardly extending or vertical leg 79 to which web 76 is lap welded, and an inwardly extending toe 81. In one example, the length of toe 81 is such that a gap between it and the opposed toe 81 of the other side sill be less than 7'-0". As the gap is narrower than the container, the edge of toe 81 may tend to lie roughly 6 inches inboard (and underneath) of the edge of an 8'-0" wide container, when loaded.

Side beams 42, 44 each include an array of vertical support members, in the nature of stiffeners, or posts 102, that extend between bottom chords 78, and top chords 70. Side posts 102, have the form of steel channel sections welded along the outside face of side beam 42, 44. The legs of the channel section are tapered from a wide top to a narrower bottom. The back of the channel stands outwardly from web 76, and the toes of the channel abut web 76 to form a closed hollow section. Side posts 102 are located abreast of, i.e., at longitudinal stations corresponding to, the longitudinal stations of the junctions of cross-ties 58, 60 with the side beams 42, 44 and also at longitudinal stations intermediate to the longitudinal stations of the cross beams and cross-ties, and longitudinally outboard of cross beams 54, 56. The longitudinal pitch of the posts 102 is, preferably typically, about 40 inches from the next adjacent post.

End side post 104 has the form of a tapered channel mounted to side beams 42, 44 at longitudinal stations corresponding to the 40 foot container support positions, that is, adjacent to, or abreast of, the junctions of end cross members 54, 56 with bottom chords 78 of side beams 42, 44. Center side posts 106 each have the form of a fabricated tapered channel mounted toes-inward to side beams 42, 44 at locations corresponding to (that is, abreast of) the junctions of centre cross member 52 with side beams 42, 44 and, more particularly, with bottom chords 76 thereof.

Posts 104, 106 are of generally heavier section than the side posts 102. For example, in the embodiment illustrated in the Figures, post 102 may preferably have a wall thickness of about ¼"; a back width of about 5-½"; and a leg depth tapering from 5¾" adjacent the top chord to about 2½" at the bottom end of the taper adjacent to the bottom chord. By contrast, reinforcing post 106 may preferably have a back width of about 10 inches, a leg taper from about 5¼ inches to about 4 inches, and a wall thickness of about ⅜ inches. Reinforcing post 104 may be a hat pressing preferably having a back width of about 10 inches, legs tapered from 5¼ inches adjacent to the top chord to 4 inches adjacent the bottom chord, and a wall thickness of about ¼ inch. Furthermore, a reinforcing member smoothly profiled doubler plate 108, is mounted to the outboard face of web 76, and underlies the footprint of the toes of post 104, or post 106 as the case may be. Thus the local cross-section of the side beams at the location of reinforced posts 104, 106 at mid height between the top chord 70 and the bottom chord 78 has a higher second moment of area for resisting lateral flexure of the top chords 70 than intermediate side posts 102. The difference in section reflects a difference in function, as described below.

Referring to FIGS. 1*b* and 2, the doubler plate 108 is generally planar and is sandwiched between web 76 and the center reinforcing post 106. A doubler plate 108 is also sandwiched between web 76 and the end reinforcing posts 104. The flared and radiused lower end of doubler plate 108 has a bottom linear edge 110 that abuts vertical leg 79 in the same region in which the end of cross member 52 is bolted through vertical leg 79. Linear edge 110 preferably extends beyond this area while still abutting with vertical leg 79. From its linear edge 110, doubler plate 108 tapers vertically upward toward a narrower upper end 111 that is wider than, and centered about, the reinforced side post 106, 104. The tapering edges 112 of the reinforcing member 110 may be generally concave and semi-parabolic. The end 111 may have a relatively small vertically oriented parabolic rebate 114 therein.

Side beams 42, 44 are mounted to end structures 36 and 38 at either end of car 20. End structures 36 and 38 each has a stub center sill having a draft pocket defined at its outboard end for mounting a railway coupler. A main bolster 65 extends laterally to either side of the stub sill. The distal tips of the main bolster being connected to the side beams structure. An end sill runs between the side beams and the outboard end of the stub sill. A shear plate overlies the end sill, and main bolster, and extends transversely outboard to the side beams.

Central Cross Member

Referring to FIGS. 5, 6*a*, 6*b*, 7, and 8, center cross member 52 is formed from a monolithic piece of rolled steel plate, having a medial, or spanning portion 116 terminating at either end in first and second end portions having end attachment fittings in the nature of upwardly bent toes 118, 120 having bolt holes for attachment to the side beams. Center cross member 52 has a grain direction G running parallel to the longitudinal axis 51 of the cross member 52. When mounted in car 20, longitudinal axis 51 of cross-member 52 extends transversely with respect to car 20 generally, that is, perpendicular to the central plane 24 of car 20. Spanning portion 116 has a generally rectangular shape and a substantially uniform thickness of about 2". Spanning portion 116 of cross member 52 has a width of roughly 17½", sufficient to accommodate the ends of two intermodal cargo containers, used when two 20 foot cargo containers are loaded end-to-end in well 40 of the car.

Figure 5:
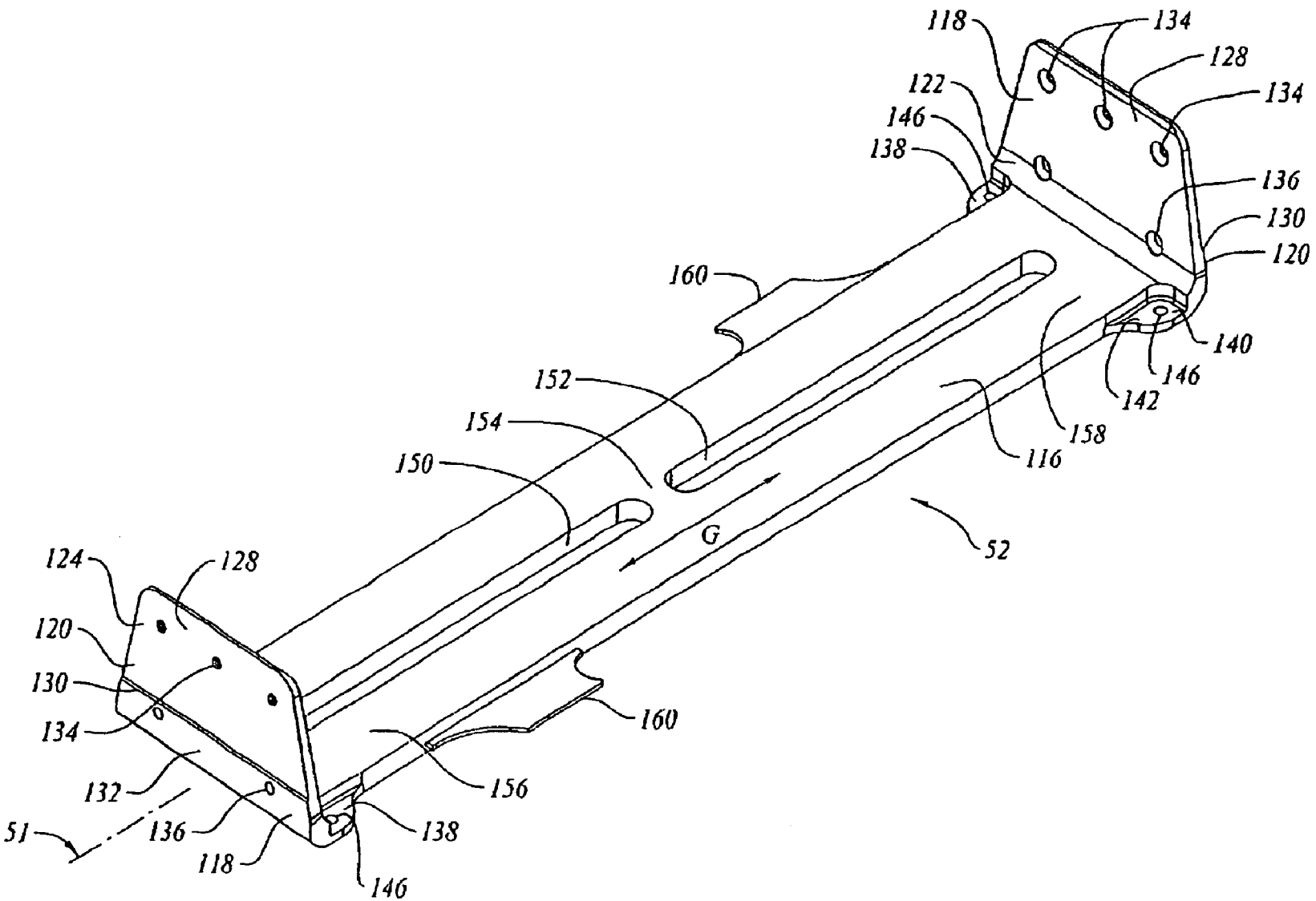
FIG. 5 is a perspective view of a center cross member of the rail road car of FIG. 1*a;*
Figure 6A:
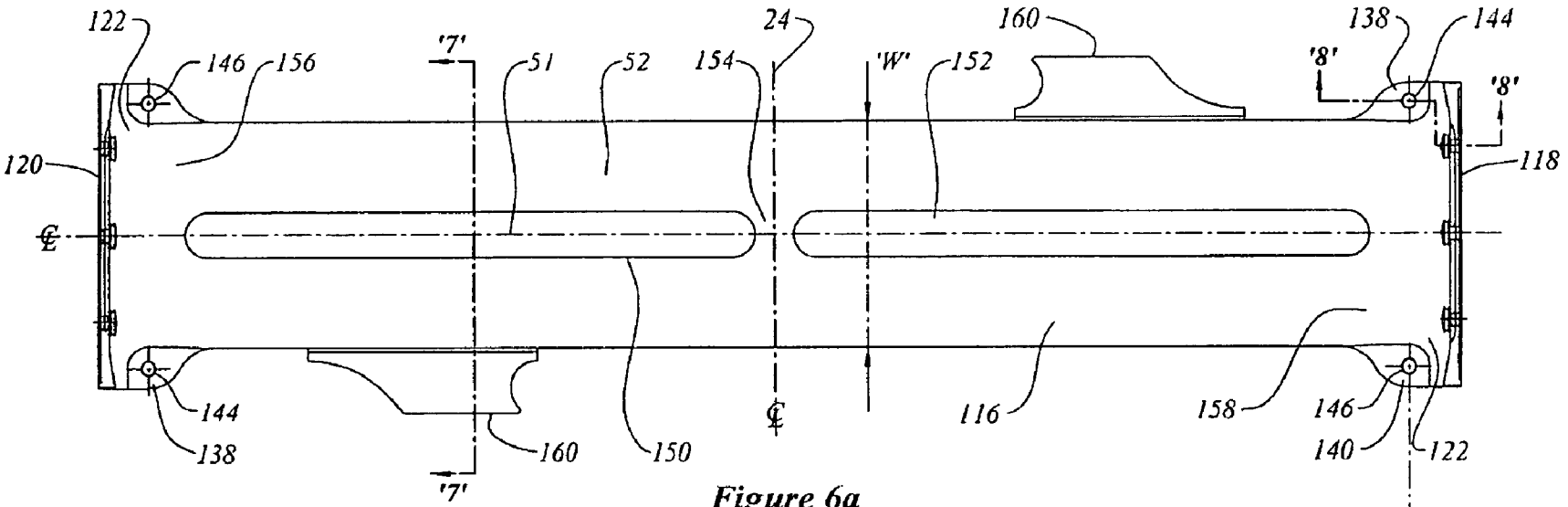
FIG. 6*a* shows a top view of the center cross member of FIG. 5.
Figure 6B:
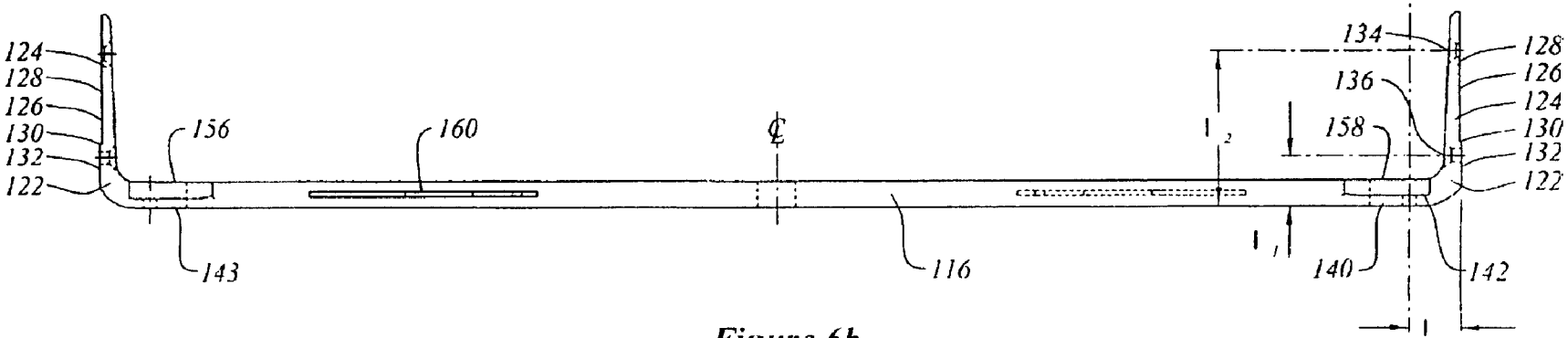
FIG. 6*b* shows a side view of the center cross member of FIG. 5.

Although toes 118 and 120 could be machined from a solid block, they are preferably formed by heating a lateral bend area, generally indicated as 122 in FIGS. 5 and 6*b*, of center cross member 52, the area 122 being proximate to each end of the center cross member 52. The bend area 122 is heated to a temperature typically between about 1300° F. and 1400° F., and preferably to about 1350° F. Center cross member 52 is then bent at the area of heating from an initial state as a flat monolith in the nature of a flat bar or plate, of desired profile, to form bent toes 118, 120. Center cross member 52 may then be left to cool to room temperature in still air. The edges of the center cross member 52 proximate to the bend area 122 may tend to bulge due to the bending process. As these bulges (not shown) may otherwise possibly tend to provide fatigue crack initiation sites, they are machined or ground flush to the edge of the center cross member 52, with the grinding marks being longitudinal with the grain G (FIG. 5). As formed, when viewed from the side (perpendicular to axis 51), cross member 52 has a U shape. It is desirable that the steel from which cross member 52 is made be "50 yield" or better, that is, that it have a yield stress of greater than 50 kpsi. In one, preferred embodiment, cross member 52 has a yield of about 60 kpsi.

Toes 118, 120 each include an upwardly extending preferably trapezoidal flange 124 of tapering thickness for connection to the generally vertical side beams 42, 44. Bent toes 118, 120 project in the same direction, namely upwardly, when installed, and are oriented substantially normal to the longitudinal axis of cross member 52. Toes 118, 120 taper from a relatively thick root at bend area to a thinner, chamfered distal tip. The outboard surface 126 of the flange 124 is stepped, having a first, or distal portion 128 machined to present a planar surface normal to, (that is, perpendicular to) the longitudinal axis of the cross member 52 thereby providing an attachment interface surface for mounting against the lower portion of side beam web 76. Outboard surface 126 of the cross member 52 is machined to have a chamfered step 130 between distal portion 128 and proximal portion 132 to accommodate the overlap of side beam web 76 on the inside face of upwardly extending leg 79 of bottom chord 78. Proximal portion 132 provides another planar surface, in this case for placement directly against vertical leg 79 of bottom chord 78.

Figure 7:
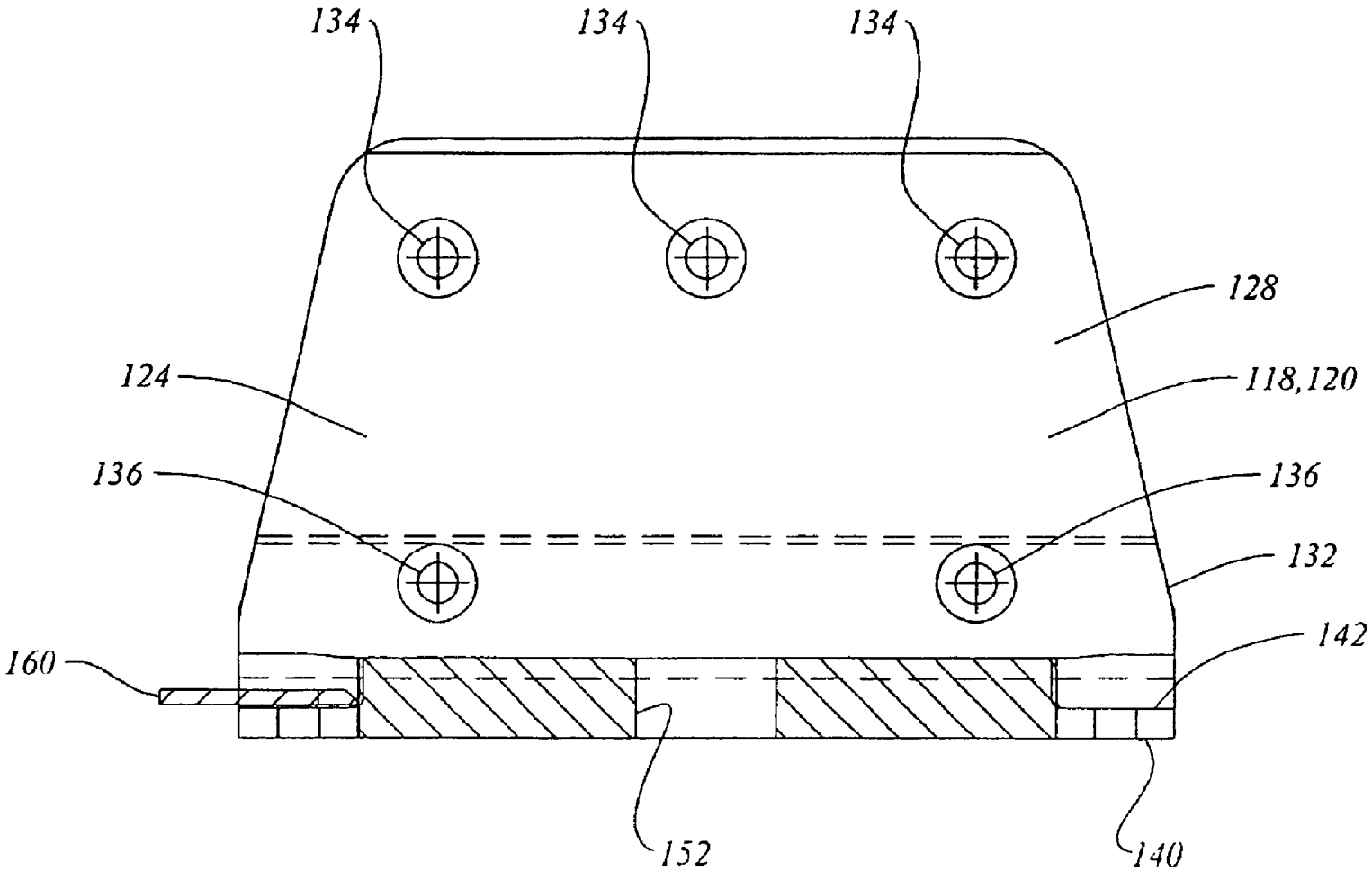
FIG. 7 shows a cross-sectional view of the center cross member taken on '7-7' of FIG. 6*a;*

Flanges 124 are also wider at the proximal end (that is, closer to the bend of bend area) as shown in FIG. 7. That is, the trapezoidal profile of toes 118, 120 narrows from a wider base adjacent bend area 122 to a narrower upper region at the distal tips of toes 118, 120. The attachment fittings each have a set of three countersunk through hole bores 134, formed in distal portion 128, and an additional pair of first and second countersunk through hole bores 136 formed in proximal portion 132. Countersunk bores 134 and 136 admit fasteners by which toes 118, 120 can be attached to side beams 42, 44 respectively by mechanical fasteners as opposed to welding. Although threaded fasteners such as high strength bolts or other fasteners such as rivets could be used, it is preferred to use Huckbolts™ for this connection.

Each end attachment fitting of cross member 52 has a pair of first and second machined ears, or lugs 138, 140 that extend to either side of the medial portion. Lugs 138 and 140 have a machined upper surface 142 for engagement by the head of a fastener, and a parallel machined lower planar surface 143 providing an engagement interface for placement against the upper surface of inwardly extending toe 81 of bottom chord 78. The rebate formed by machining the upper surface of lug 138, 140 provides a niche in which a mechanical fastener can seat shy of (that is, out of the way of items placed on) the plane of the upper surface presented by cross member 52 to the bottom of shipping containers. Lugs 138, 140 are smoothly radiused to merge into the body of spanning portion 116 more generally. Lugs 138 and 140 are generally coplanar, and are provided with through bores 144, 146 by which a bolted connection can be made. Rivets or other mechanical fasteners could be used, but high strength Huckbolts™ are preferred. Lugs 138 and 140 merge at the bent region with the transverse end vertical flange, namely flange 124. The end portion measured across lugs 138, 140 is thus wider than the adjacent spanning portion of beam 52.

To reduce weight, a pair of slots 150, 152 may be machined in spanning portion 116, as shown in FIGS. 5 and 6*a*, the long dimension of the slots running parallel to the longitudinal centerline of the cross member 52. Slots 150, 152 preferably pass clear through cross member 52 and, may be about 3" wide and 45" long. Slots 150, 152 are separated by web bridge at mid-span, indicated as 154, web bridge 154 being preferably about 3" wide. The upper surface of cross member 52 includes first and second end regions that present a container support interface in the nature of first and second planar surface portions 156, 158 of sufficient width to accommodate end corner fittings of two 20 foot containers carried end-to-end in well 40.

Cross member 52 also includes a pair of first and second diagonal brace fittings in the nature of strut root transition or connection plates 160 welded to opposite sides of spanning portion 116 near respective toes 118, 120. Transition plates 160 are gusset-like plates that provide a surface to which an end of diagonal cross brace 61 can be welded at the oblique diagonal angle of FIG. 1, and provide a flared and radiused end (a fatigue detail) by which the forces carried in diagonal cross brace 61 may tend to be passed effectively and gradually into member 52.

Both strut root transition plates 160 have concave arcuate portions adjacent to the proximal end of the flange, with the arcuate portion opening towards the lateral centerline of the cross member 52. Both the first and second strut root transition plates, as described above, may be similar in shape and orientation to those illustrated and described below for the end cross members 54, 56.

Cross member 52 (FIG. 2) is preferably installed by inserting a fastener such as item 57 (preferably a Huck-bolt™ for mating connection with item 59, preferably a Huck-bolt™ collar) through various bores 134, 136, 144, 146 to provide a rigid connection between cross member 52 and side beams 42, 44. The connections made through bores 134, 136, 144, 146 may tend to permit the transition of moment between side beams 42, 44, cross member 52 and center post 106 (FIG. 4*a*). While a welded connection could also be used, a mechanically fastened connection is preferred.

However, a bolted connection is normally preferred over welding in such cases to reduce the likelihood of fatigue cracks that may develop in the connection. When installed, cross member 52 overlaps with inwardly extending toe 81 of bottom chords 78. This overlap permits the bottom chord 78 to help support a vertical load placed on the cross member 52, particularly when the load is placed on load bearing surface portions 156, 158 of the cross member 52 for supporting a shipping container.

Container Stop

Referring to FIGS. 18 to 24, in a preferred embodiment of cross beam 52, designated 53, a member in the nature of a container stop, or longitudinal stop block 173, for inhibiting movement of an intermodal cargo container, is included. Stop block 173 is located within a receptacle 169. A bore 177 defines receptacle 169 for receiving stop block 173. Bore 177 passes through a thickness of cross beam 53, and may be formed, for example, by drilling or burning cross beam 53.

Stop block 173 is preferably located adjacent an end of cross beam 53, for example, adjacent one of upwardly bent toes 118, 120 in a position for obstructing longitudinal shifting of the corners of 20 foot shipping containers carried in the well. In this embodiment, slots 150 and 152 are shorter than described above to provide somewhat larger first and second planar surface portions 156 and 158, having sufficient width to accommodate at least one stop block 173. Cross beam 53 is also be provided with a second longitudinal stop block 173 located at an opposite end thereof.

Figure 24:
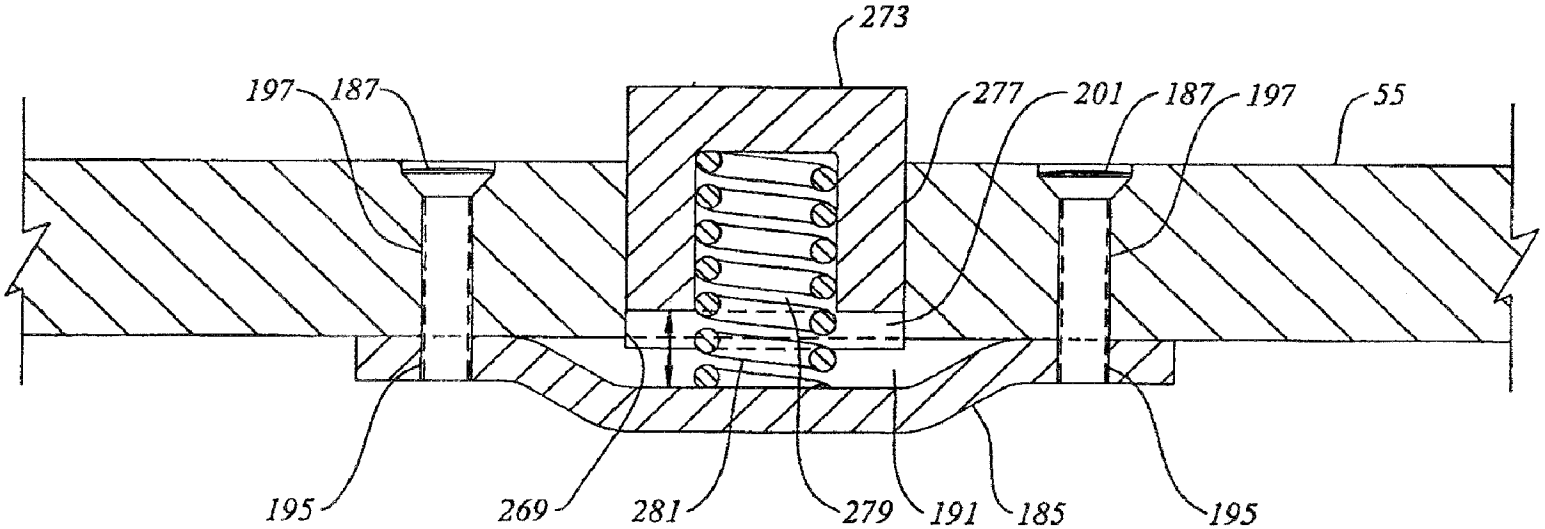
FIG. 24 shows a partial cross-sectional view of the cross beam and stop block of the rail road car of FIG. 1*a* taken along the line 24-24 of FIG. 23.

Stop block 173 is preferably generally cylindrical in shape and may have a blind bore or rebate 179 located in the end thereof such that stop block 173 is hollow. Rebate 179 is configured to receive a biasing member in the nature of a spring, such as a coil spring 181. An end 183 of coil spring 181 extends beyond rebate 179 and is captured between the inside face of the top stop block 173 and a retainer identified as bottom support plate 185, affixed to lower planar surface 143. Support plate 185 may be affixed to lower surface 143 using a fastener, such as a threaded fastener 187, inserted through hole 195 in support plate 185. Fastener 187 may be tightened into a threaded bore 197 in lower surface 143 (see FIG. 20). Referring to FIG. 24, in an alternative configuration, bore 197 may be a smooth clearance hole, and may pass through cross member 52 to permit fastener 187 to be inserted therethrough in a direction opposite to that previously described, and secured by either tightening it into support plate hole 195, which may be threaded, or by tightening a nut on the opposite side thereof. In either configuration, spring 181 biases against both support plate 185 and stop block 173, tending thereby to encourage stop block 173 to protrude from planar surface portion 156 or 158, as the case may be, in an extended position.

Stop block 173 may be configured to have a cross-section that is substantially the same size and shape as a cross section of bore 177 so that it may be positioned in a sliding or slip fit engagement therein. While stop block 173 and bore 177 are preferably generally cylindrical, and each have a substantially circular cross-section, they may alternatively have generally rectangular or square cross-sections, as shown by stop block 273 and bore 277 in FIGS. 22-24. Stop block 173 preferably has a 3.25" diameter, if cylindrical, and has a 3"

square cross-section, if a rectangular stop block 273 is used. A metal such as steel is preferably used to manufacture stop block 173 or 273.

If bore 177 is created, for example, by drilling cross-beam 53, then a cylindrical bore is formed by the path of the drill bit. Conversely, a bore having some other cross-sectional shape, such as a rectangular shape, may require additional machining to modify the cylindrical path defined by the drill bit to the alternative shape. Employing a cylindrical bore may also facilitate control of manufacturing tolerances. A cylindrical bore may also lead to less stress concentration in cross-member 53 about bore 177.

Figure 18:
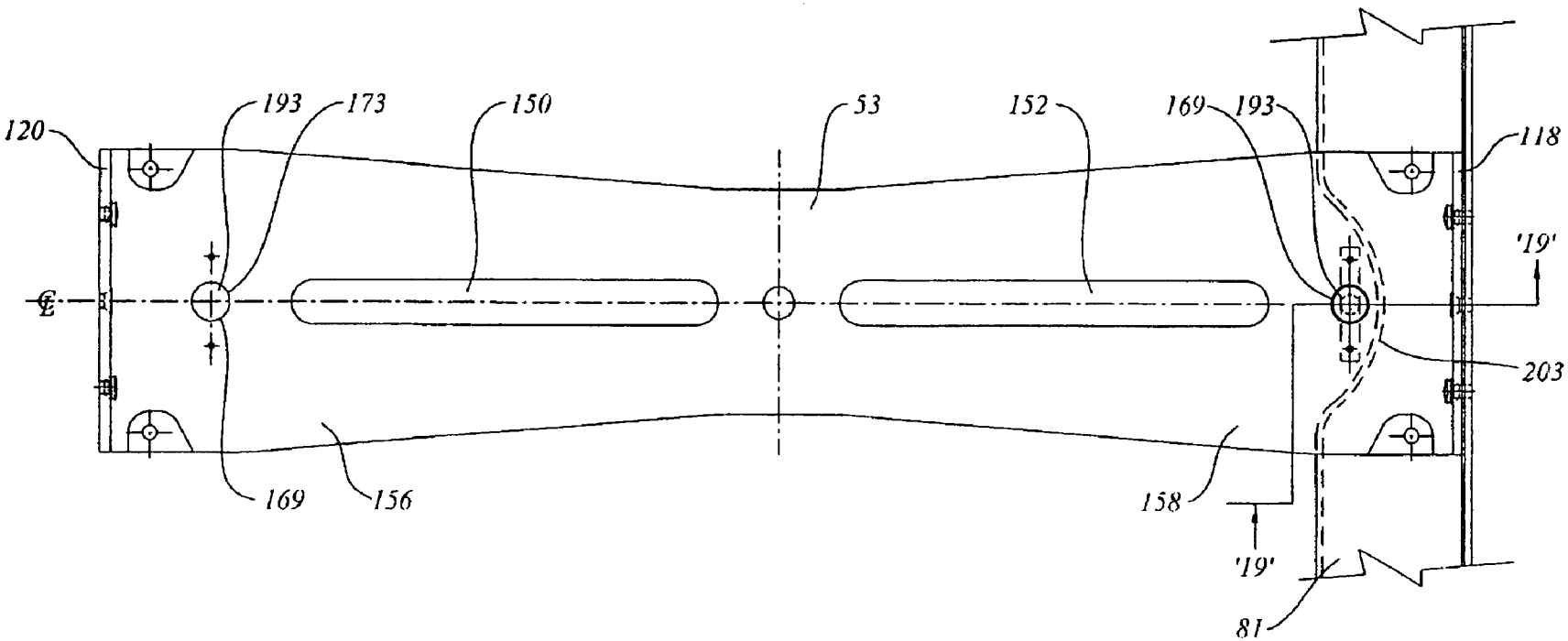
FIG. 18 shows a partial top view of the rail road car of FIG. 1*a* showing center cross beam connected to a side of said rail road car.
Figure 19:
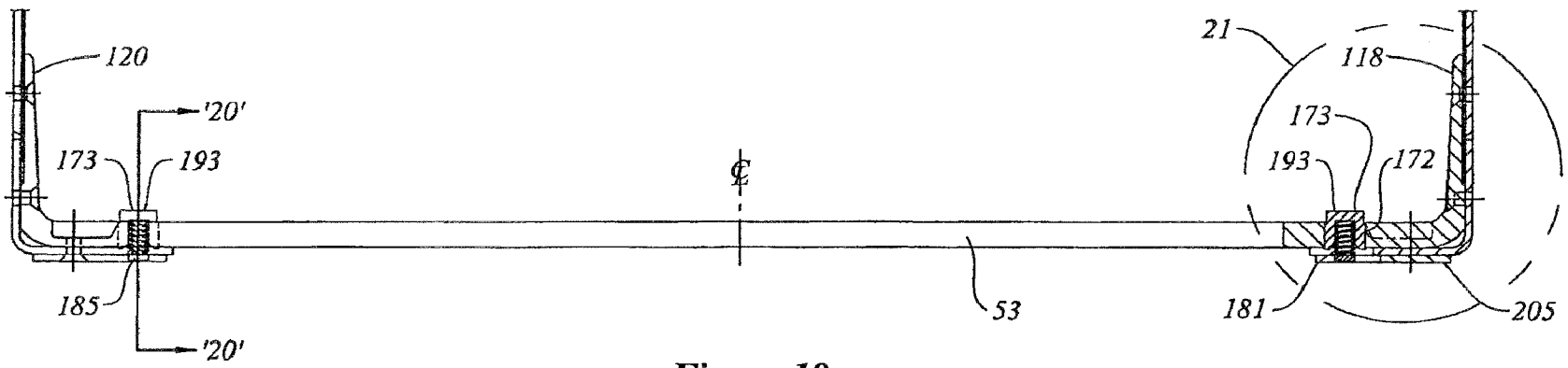
FIG. 19 shows a partial end view of the rail road car of FIG. 1*a*, revealing a partial cross-sectional view of the center cross beam of FIG. 18 showing a cross section taken along line 19-19 of FIG. 18.
Figure 20:
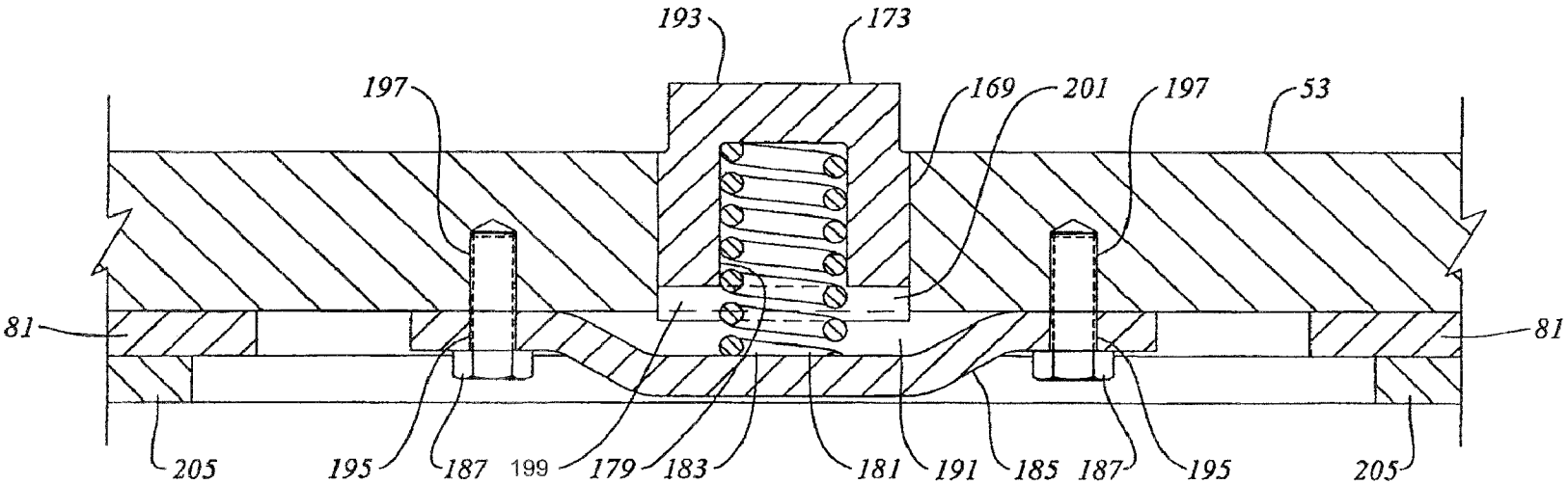
FIG. 20 shows a partial cross-sectional view of the cross beam and stop block of the rail road car of FIG. 1*a* taken along the line 20-20 of FIG. 19.

As can be seen in FIG. 18, cross-member 53 also differs from cross-member 52 in that it flares, being wider adjacent upwardly bent toes 118, 120 than at its waist adjacent mid-span web bridge 154. This creates widened planar surface portions 156 and 158, which may be advantageous in discouraging concentrations in the stress field adjacent bore 177.

When assembled within cross-beam bore 177, stop block 173 is biased by spring 181 so that it protrudes or projects proud of planar surface portion 156 or 158, as the case may be. At least a portion of stop block 173 remains within bore 177 so that lateral movement thereof may be inhibited. When a generally vertical force is applied to a free end 193 of stop block 173, tending to compress spring 181, stop block 173 preferably depresses into bore 177 so that free end 193 is at least flush with (that is, flush with or shy of) surface portion 156 (or 158). Free end 193 is preferably rounded or generally planar, lying transverse to a longitudinal axis of stop block 173.

Figure 21:
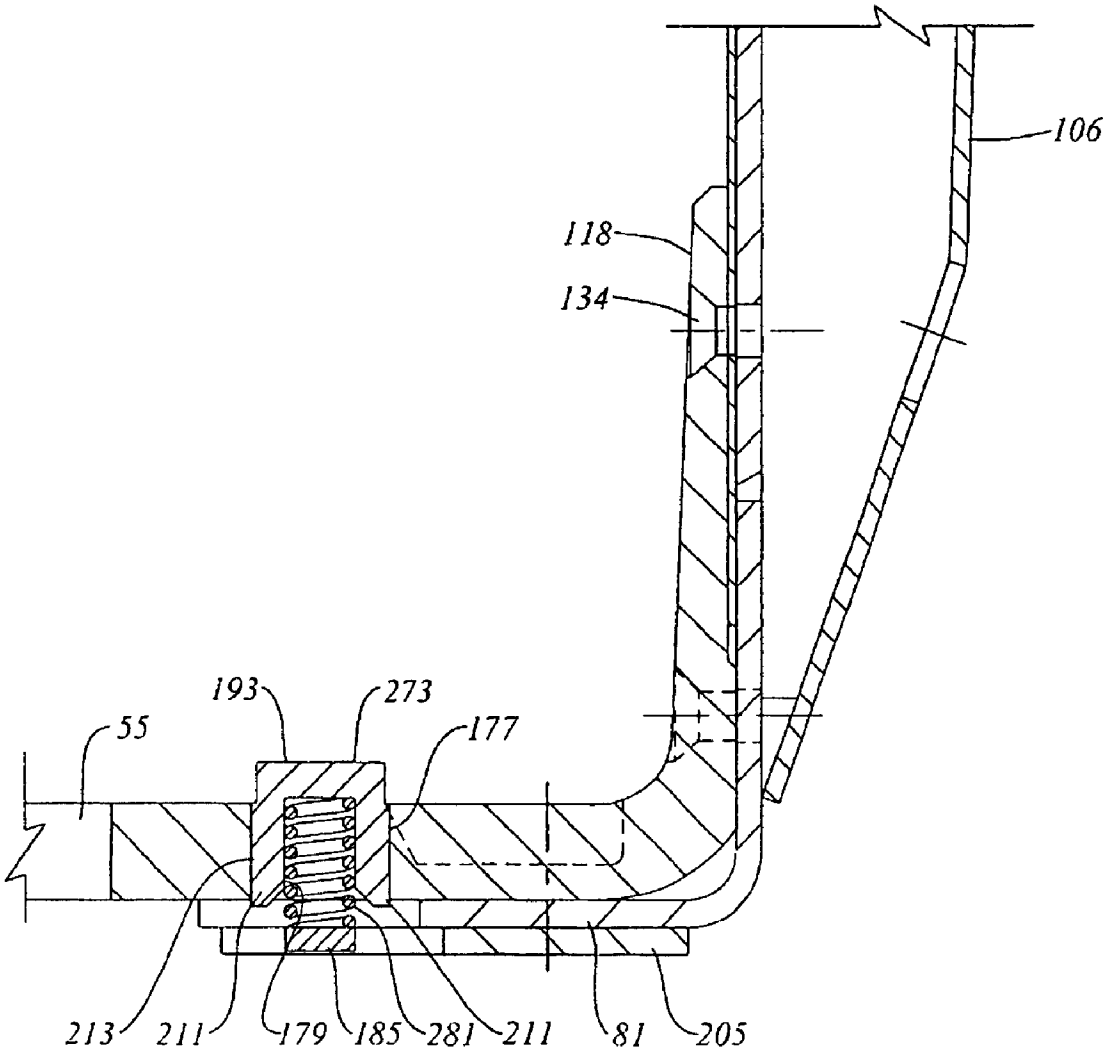
FIG. 21 shows a magnified view of the cross section of FIG. 19.
Figure 22:
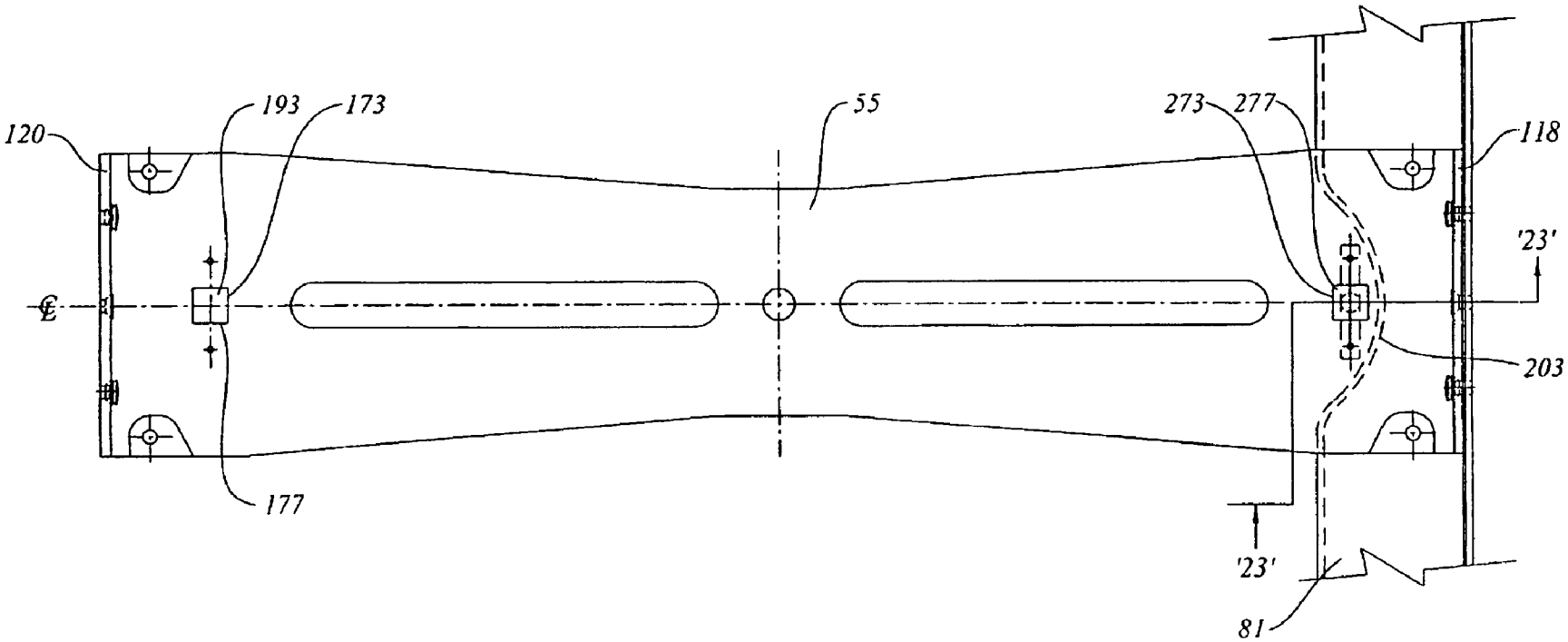
FIG. 22 shows a partial top view of the rail road car of FIG. 1*a* showing center cross beam connected to a side of said rail road car and having an alternate stop block.

To inhibit further protrusion from surface portion 156 (or 158) of stop block 273 beyond bore 277 when stop block 273 is biased by spring 281, stop block 273 may be provided with one or more transverse tabs 211 (as shown in FIG. 21). Tabs 211 are preferably located adjacent a proximal end 213 of stop block 273, and may be oriented to protrude in generally opposite directions to one another, each extending generally transversely to a longitudinal axis of stop block 273. Cross beam 55 is assembled by inserting stop block 273 into bore 177 (starting at lower planar surface 143), placing spring 281 into rebate 179, compressing spring 281 with support plate 185, and fastening support plate 185 to lower planar surface 143. Alternatively, if stop block 173 is not provided with tabs 211, support plate 185 may be installed first. Spring 281 may then be inserted into bore 277 from opposite side of beam 55, and stop block 273 may be placed thereon, being partially inserted into bore 277.

To provide adequate structural support in cross beam 53 or 55 for stop block 173 or 273, as the case may be, bore 177 (or 277) is preferably generally centered, being located adjacent cross beam longitudinal axis 51. Since longitudinal stop block 173 or 273 is preferably generally centrally located within well 40, one 20-foot cargo container may be located to either side of stop block 173 or 273.

Receptacle 169 (or 269) may additionally include at least one longitudinal channel (not shown) to allow for water drainage therethrough. Similarly, bottom support plate 185 may be curved to form a gap 191 between it and the lower planar surface 143. Gap 191 permits a longer spring to be used and also permits block 273 to travel further before bottoming on plate 185, compression of which may be more resistant to deformation than a shorter stop block when subject to force. A longer stop block 173 or 273 may also be accommodated by providing stop block 173 or 273 with lengthened fore-and-aft skirts 201 which define a transverse channel therebetween. When stop block 273, for example, is moved to its retracted, or depressed position, skirts 201 lie to either side of support plate 185. When stop block 173 is depressed, spring 181 compresses, and support plate 185 enters channel 199. Further movement of stop block 173 is then inhibited by support plate 185 abutting stop block 173.

Figure 23:
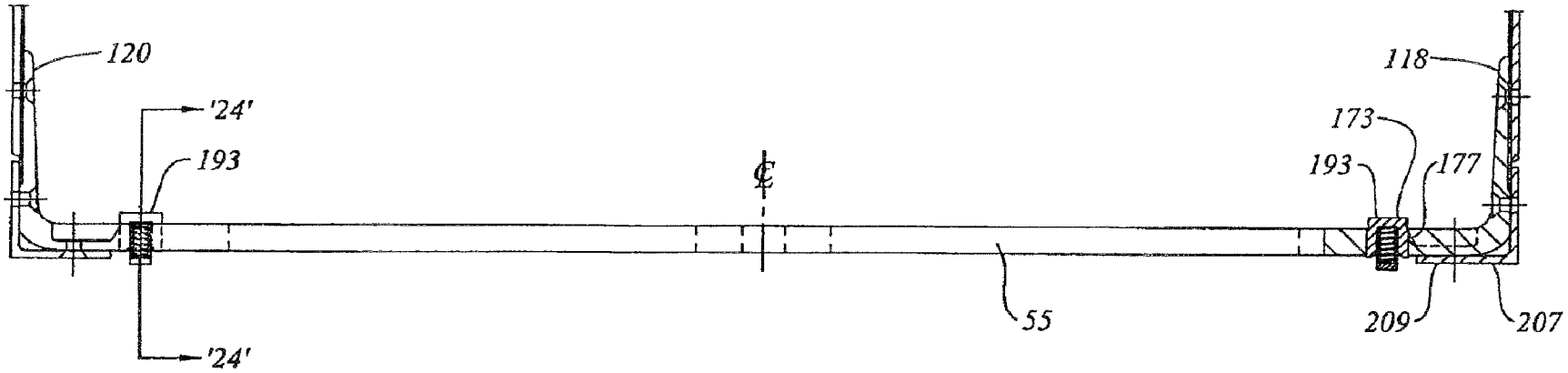
FIG. 23 shows a partial end view of the rail road car of FIG. 1*a*, revealing a partial cross-sectional view of the center cross beam of FIG. 22 showing a cross section taken along line 23-23 of FIG. 22.

Cross members 53 and 55 are installed in substantially the same manner as described above for cross members 52. To accommodate support plate 185 and passage of stop block 173 or 273, inwardly extending toe 81 of bottom chord 78 is provided with a relief in the nature of a notch or recess 203 (shown in stippled lines in FIGS. 18 and 22) adjacent to the juncture of the cross member (be it 53 or 55) with the side beam (be it 42 or 44). Toe 81 is preferably strengthened by adding a laminate member in the nature of a doubler plate 205 thereto. Alternatively, instead of a plate 205, a thick bottom chord 207 may be employed, as shown in FIG. 23. If a thicker bottom chord 207 is used, toe 209 thereof may be shorter, and as a result toe 209 may not have a recess similar to recess 203 to be formed therein to permit passage of stop block 173.

In operation, if a long container, such as a 40-foot container, sits on top of the stop block 173 or 273, the long container may depress the block 173 or 273 from its upwardly biased or extended position into the cross beam 53 or 55, compressing spring 181 or 281 therein. When a 40-foot or longer container is removed from the well 40 of the railcar 20, spring 181 or 281 may then urge stop block 173 or 273 upwardly into its extended position.

Corner castings of standard cargo containers (not shown) may have longitudinal slots located therein. These slots are dimensioned to provide clearance between the slots of the corner castings and locating cones 68. This means that when the first of two 20-foot containers is placed in one end of well 40 of railcar 20 atop locating cones 68, the clearance provided by the corner casting slots may result in the container coming to rest on top of stop block 173 or 273. When a second 20-foot container is placed in the other end of well 40 of railcar 20, the container may be placed onto stop block 173 if the first container is not already located thereon. When the rail car 20 is initially moved along, it may initially be subjected to longitudinal accelerations and decelerations which may serve to cause the containers to slide longitudinally. Longitudinal shifting of the containers may tend to allow stop block 173 or 273 to be urged by spring 181 or 281 to an extended position, protruding from planar surface portion 156 (or 158, as the case may be) as the container depressing stop block 173 or 273 moves to clear stop block 173 or 273. Once stop block 173 or 273 extends in this manner it may act to discourage further longitudinal shifting of the containers within well 40 by abutting an adjacent edge or side of a container as the container moves within the well 40 during transport thereof. Extension of stop block 173 or 273 may occur in this manner before railcar 20 is subject to more severe inertial and dynamic loading at higher speeds.

Container Guide

In an alternative embodiment, stop block 173 may operate in conjunction with a pivotable container guide assembly, as shown in co-pending U.S. Pat. No. 6,354,778, issued Mar. 12, 2002, and incorporated herein by reference.

End Cross Members

End cross beam members 54 and 56 are shown in FIGS. 9, 10*a*, 10*b*, 11, 12 and 13. End cross beam members 54, 56 are identical in configuration, such as a description of one will also serve to describe the other. End cross beam member 56 includes a first beam member in the nature of a monolithic lower closure plate 170 and a second beam member in the nature of a formed cover plate 172 having the cross-section of a formed C-channel mounted to monolithic lower plate 170 to form a beam of hollow closed section. Although a beam of solid section could be used, it is preferable to employ a hollow section, as shown. A portion of monolithic lower plate 170 forms a first flange portion 174 (that is, the lower flange of end cross beam member 56), and a portion of upper cover plate 172 forms a second, upper flange portion 176 of the cross-member 56. The second flange portion 176 is spaced from the first flange portion 174 to co-operate to resist vertical flexure of the cross member 56. The vertical bent legs 175 of plate 172 form vertical webs connecting portions 174 and 176. End cross member 56 preferably has a generally rectangular shaped section, and, over the mid-span portion of the section, preferably has a substantially uniform thickness. In one embodiment this thickness may be about 3⅞".

Lower plate 170 has first and second end portions 178, 180 and a medial portion 182 lying therebetween. Monolithic plate 170 is bent at 171 such that end portions 178, 180 have end fittings in the nature of upwardly bent toes 184, 186 having vertically extending flanges 192 suited for installation, that is placement, against the inwardly facing surface of upwardly extending leg 79 of bottom chord, 78. Bent toes 184, 186 each have mounting fittings in the nature of a set of four spaced apart countersunk through hole bores 218 to facilitate connection of toes 184, 186 to the upward leg of the side sills of side beams 42, 44 respectively.

End portions 178, 180 also include horizontal portion 188 that, in plan view, have a wide portion 190 immediately adjacent to bend 171, and a narrower portion 194 extending away from bend 171 to an inclined step 196 at which end portions 178, 180 meet medial portion 182. Horizontal portion 188 provides a planar interface surface 189 for engaging, that is, seating upon, the upper surface of inwardly extending toe 81 of bottom chord 78. The transition from wide portion 190 to narrow portion 194 occurs along a smoothly radiused taper 198 which merges with narrow portion 194. The wings of wide portion 190 stand, symmetrically, wider relative to beam centerline 200 than the outer edges 204 of narrow portion 194 define mounting fittings, or lugs 202. Lugs 202 each have a countersunk through bore 206 by which lugs 202, and hence wide portion 190, can be fastened to bottom chord 78 by means of a mating fastener such as indicated by item 57 and 59. In the preferred embodiment, item 57 is a Huck-bolt™, and item 59 is a Huck-bolt™ collar. Alternatively, bolts and nuts or formed rivets could be used.

Upper plate 172 is formed from a steel plate having longitudinally extending margins bent at right angles to form a downwardly opening channel section 208. The legs 175 of channel section 208 are trimmed to accommodate the step in lower plate 170 with which channel section 208 mates, and is welded to, lower plate 170. Legs 175 then form the webs of a box section. In the embodiment illustrated, upper plate 172 is narrower and shorter than closure plate 170. Closure plate 170 is welded at either end to the vertically extending flanges of bent toes 184, 186.

Channel section 208 has an array of at least one, and preferably three, longitudinal slots 214 formed therethrough. Slots 214 are located adjacent to each of the vertically extending flanges 192. In the embodiment illustrated, flat bars 216 are mounted, by welding, to the upper face of end portion 178, 180 of lower plate 170. Slots 214 are narrower than flat bars 216 such that slots 214 permit flat bars 216 to be welded to the end portion of upper plate 172. The region of upper plate 172 above, and supported by, flat bars 216 provides a container support interface 217 upon which the corner fittings of containers can rest. Container cones 68 (FIG. 4*b*) are mounted at the container support interface above flat bars 216. Flat bars 216 provide support to the otherwise hollow section of upper plate 172 at the end locations, and may tend to bear a vertical compressive load to discourage the hollow end portion of upper plate 172 from collapsing under the relatively concentrated vertical load of the container corner.

Four countersunk bores 218, pass through each toe 184, 186 for receiving fasteners such as high strength bolts 57 to fasten cross beam member 56 to vertical leg 79 of bottom chord 78. In the present embodiment flange, toe 184, 186 does not extend beyond vertical leg 79, however it can also be extended and fastened in a way similar to the cross beam 52. Bores 218 are spaced apart and located adjacent the base of toe 184, 186. Although four bores are shown, as few as one bolted connection, or more than four bolted connections could be used. As illustrated, bores 218 are offset from the horizontal plane of the downwardly facing planar interface surface 189 of horizontal portion 188.

Figure 4B:
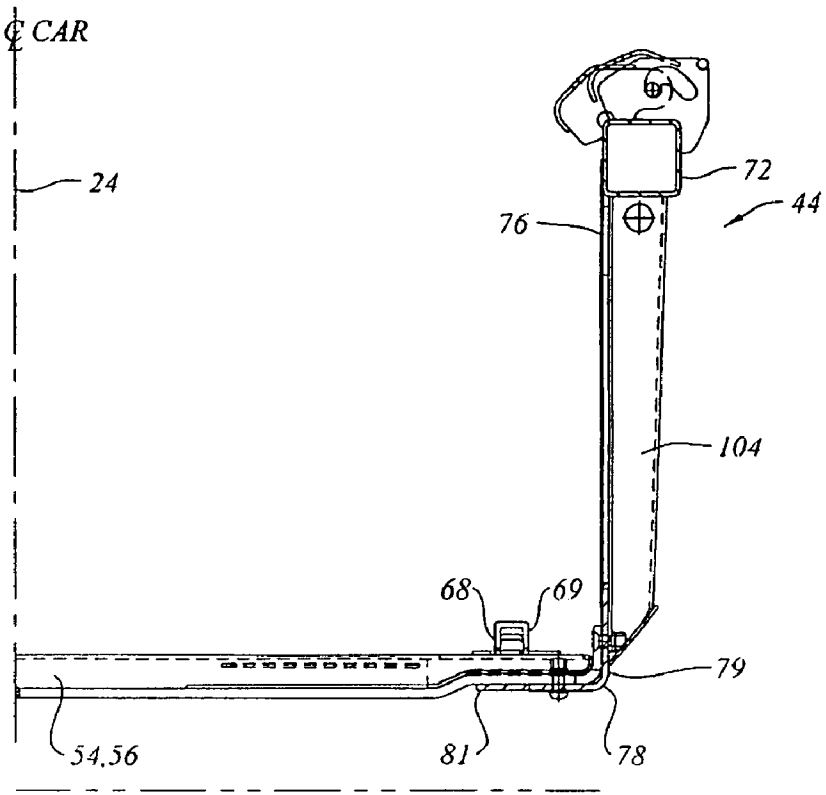
FIG. 4*b* shows one half of a cross-sectional view of the railroad car of FIG. 1*a* showing an end cross member taken on the half section at arrow '4*b*' of FIG. 1*a;*
Figure 4A:
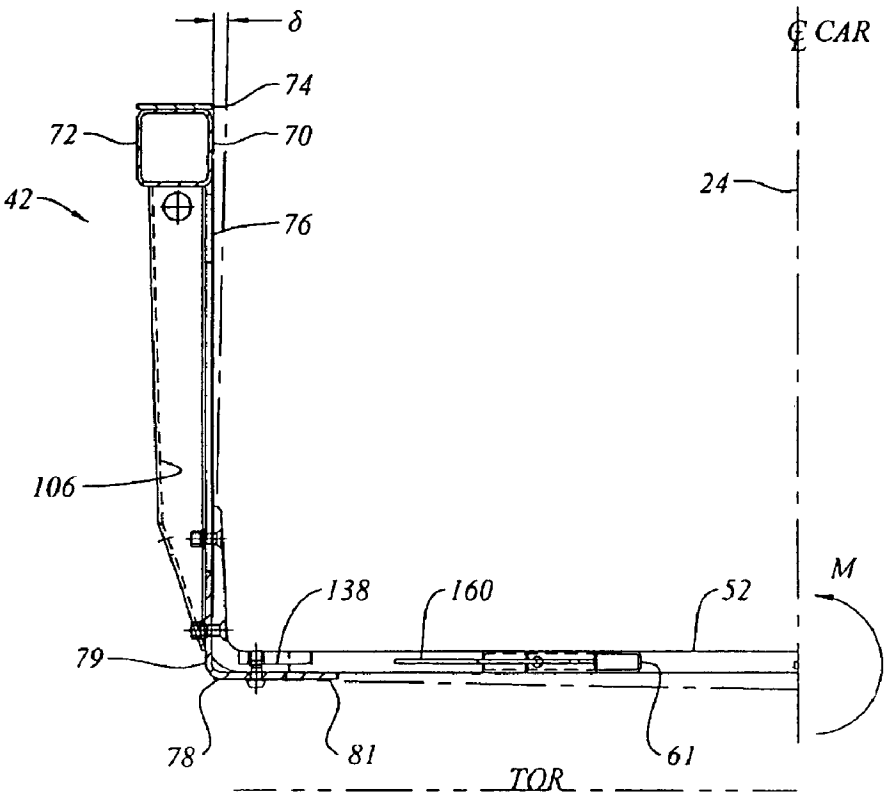
FIG. 4*a* shows one half of a cross-sectional view of the railroad car of FIG. 1*a* showing a mid-span cross member taken on the half section at arrow '4*a*' of FIG. 1*a;*

Cross member 56 is preferably installed by inserting bolts through bores 206, 218 to provide a rigid moment connection between cross member 56, side beam 42, 44, and end post 104, (FIG. 4*b*). The connection made through bores 218 may be used to transmit a moment at the inwardly extending toe 81 of the bottom chord 78. The bores 206 serve to strengthen this connection to transfer moments at the vertical leg 79 and side post 104. In the above configuration, moments may be effectively transferred between the structural elements of the railcar 20 in both the horizontal and vertical planes to resist deflection of the top chords 70 in a direction transverse to the longitudinal direction.

A mechanically fastened moment connection is preferred over welding because a bolted connection may tend to reduce the likelihood of a fatigue crack forming in the connection. Mechanical fastening may tend to facilitate the removal and replacement of damaged or worn cross members. When installed, end portions 178, 180 of cross member 56 overlap with the inwardly extending toe 81 of bottom chords 78. This overlap permits bottom chord 78 to help support a load placed on cross member 56.

Cross member 56 has a diagonal strut connection plate 220, having a generally similar profile to strut root transition plate 160, and is mounted to extend outwardly from the vertical bent leg 175 of cover plate 172. Web continuity is provided at the same level by welding an internal web plate 222 within cover plate 172 in line with diagonal strut connection plate 220. A second diagonal strut connection plate 224 is mounted to extend from the opposite side of cross member 56 at the level of the flange of the lower plate 170.

Referring to FIGS. 14, 15*a*, 15*b*, and 15*c*, intermediate cross-ties 58, 60 are having turned up toes, or end flanges 226, 228. Intermediate cross-ties 58, 60 are basically closed cross-section, built up beams. Cross-ties 58, 60 have widened ends with ears, or lugs with bores to permit fastening to toes 81 of bottom chord 78, and additional bores to permit bolting of upturned end flanges to leg 79 of bottom chord 78. Cross-ties 58, 60 have diagonal brace strut root members 230, 232 and internal gussets 234 for web continuity at the strut roots. The cross-section is of much lighter construction that the central cross beam 52 or either of end cross members 54, 56. It is not intended that cross-ties 58, 60 be capable of supporting container corner loads.

In the embodiment illustrated cross braces 61 to 64 are attached to the cross member 52, as described above. Cross braces 61 to 64 can be connected by welding directly to cross members 52, 54, 56, 58 or 60 by means of connection plates 160, 220, 224, 230 or 232 located along a side of the respective cross members. Transition plate 160 (or such as may be the case) is either attached to, or integral with, the side of the longitudinal or spanning portion 116, and is oriented to be generally coplanar with the spanning portion 116.

Connection of Cross Beams to Side Beams

Figure 8:
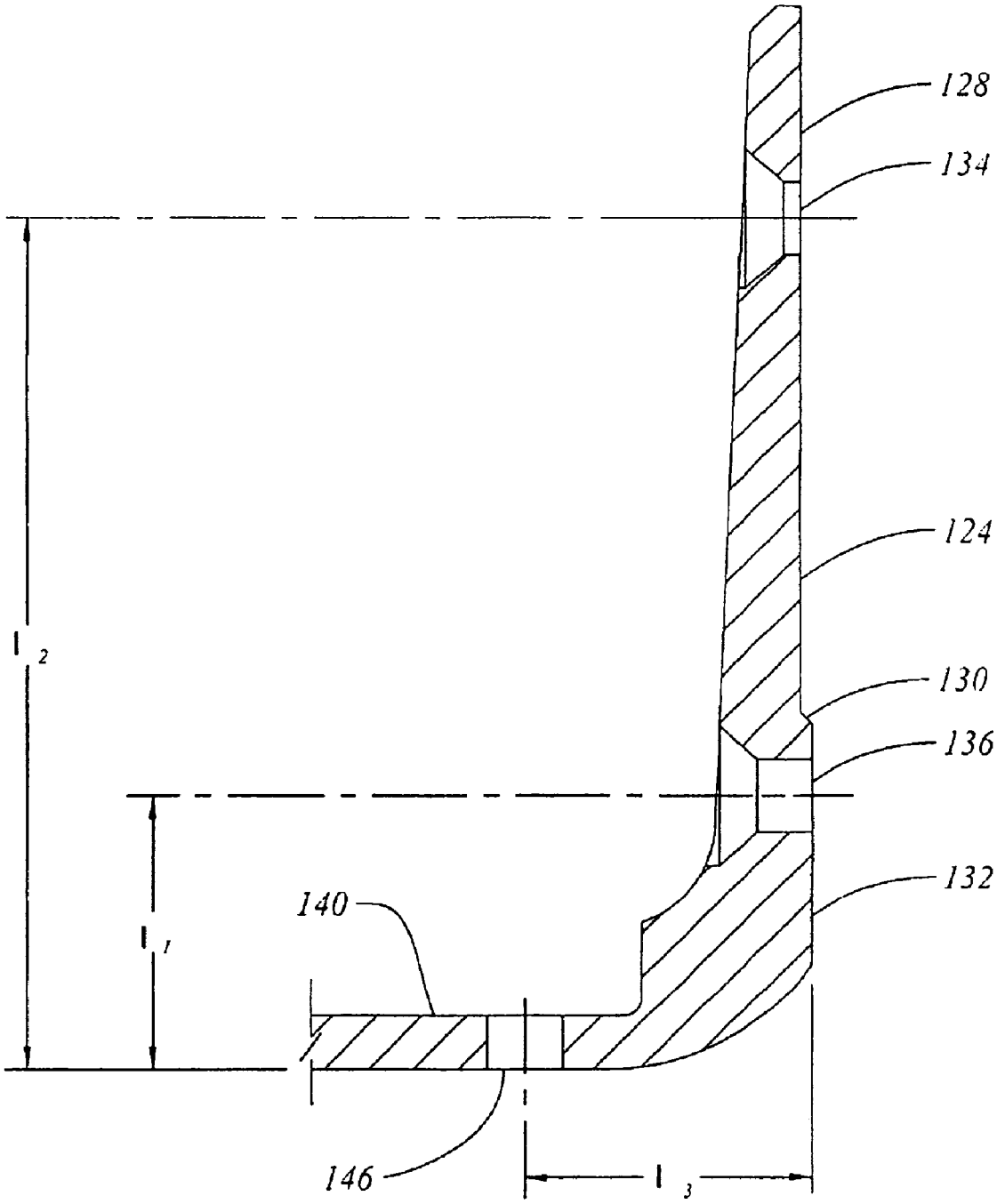
FIG. 8 shows a cross-sectional view of the center cross member taken on '8-8' of FIG. 6*a;*
Figure 9:
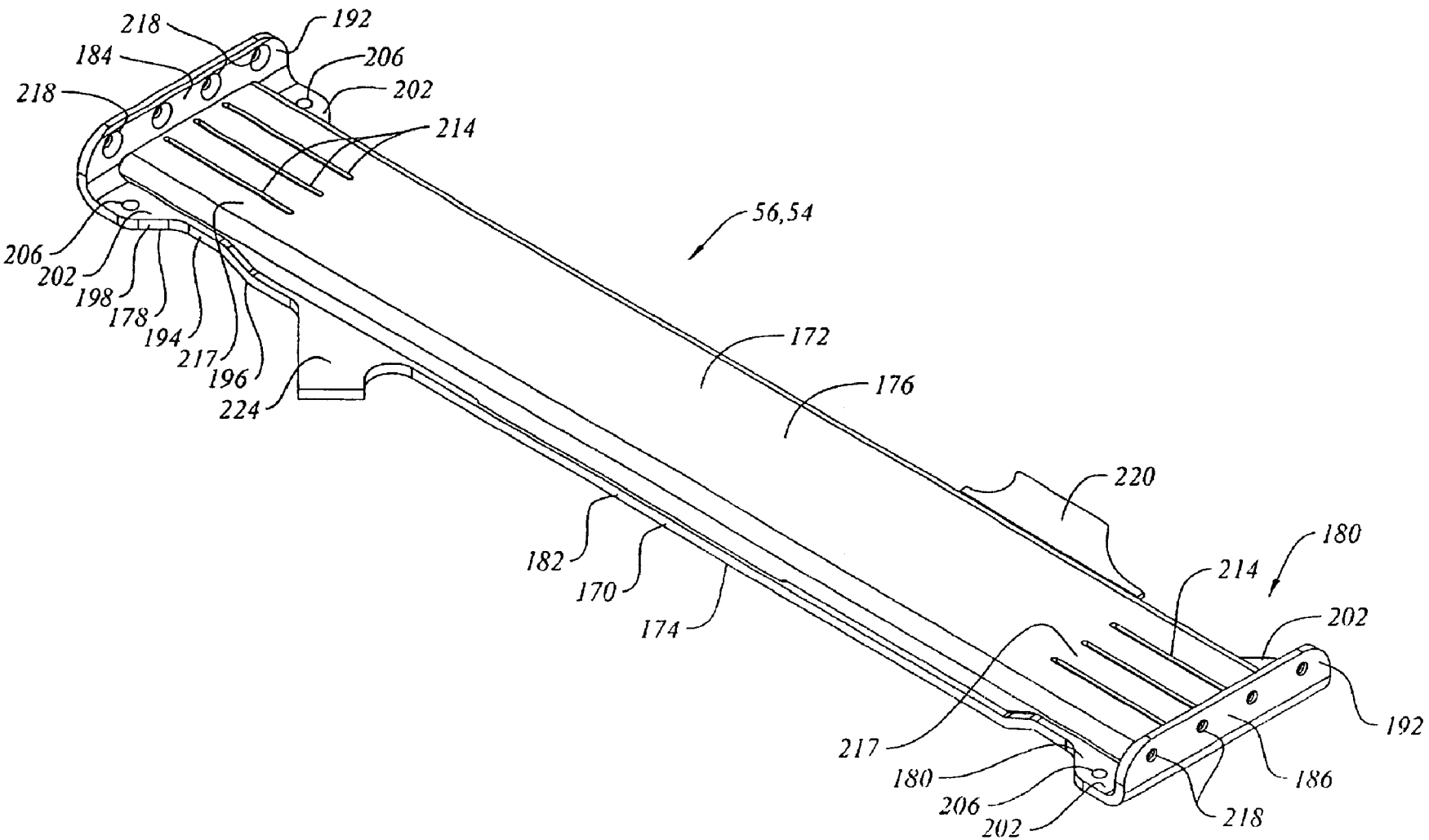
FIG. 9 is a perspective view of an end cross member of the rail road car of FIG. 1*a;*

Bottom chord 78 has bores in the nature of bolt holes located at the mid-span and 40 foot container locations to permit cross members 52 and 54, 56 respectively to be bolted into position. The inboard surface of the upwardly extending leg 79 of bottom chord 78 lies in a first, vertical plane. The upward face of the second, laterally inboard extending toe 81 of bottom chord 78 lies in a second, horizontal plane. These first and second planes intersect along a longitudinal line of intersection. In the case of mid-span central cross beam 52, the bolted connection includes a pair of bolts inserted through bores 136 lying at a first distance (that is, a vertical offset distance measured from the line of centers of the bolts) from the line of intersection of the planes by a first distance $\lambda_1$, (FIGS. 8 and 6*b*). The bolted connection also includes a second set of bolts 57 inserted through bores 134 lying at second distance, $\lambda_2$ from the line of intersection of planes, (FIG. 8). The bolted connection includes a third pair of bolts inserted through bores 146 located to bolt the side flanges of cross beam 52 to inwardly extending toe 81 of bottom chord 78, the bolts having a line of centers offset from the line of intersection of the planes a distance $\lambda_3$ (that is, a horizontal offset distance), (FIG. 8).

Figure 10A:
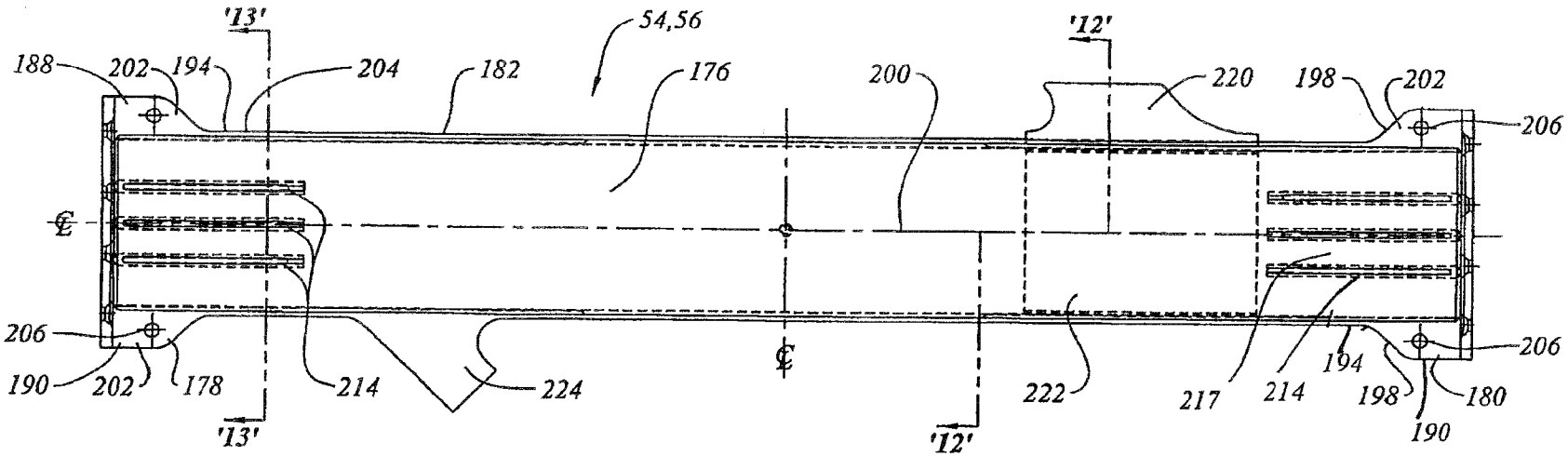
FIG. 10*a* shows a top view of the end cross member of FIG. 9.
Figure 10B:
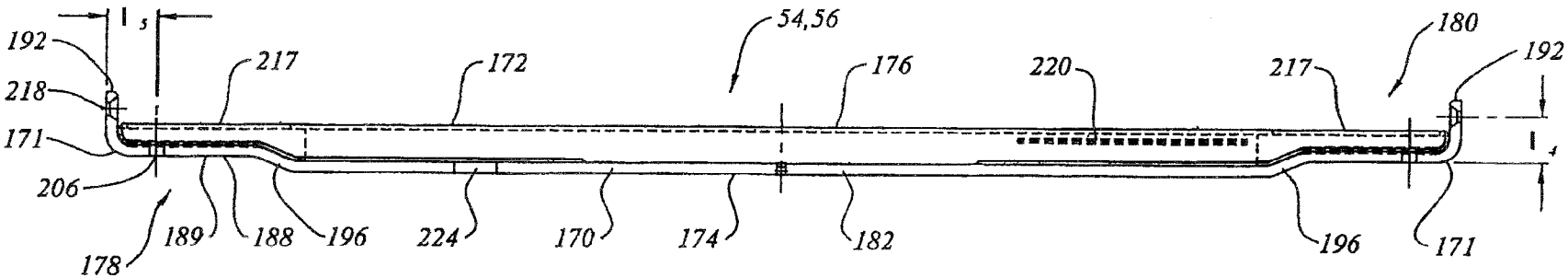
FIG. 10*b* shows a side view of the end cross member of FIG. 9.
Figure 11:
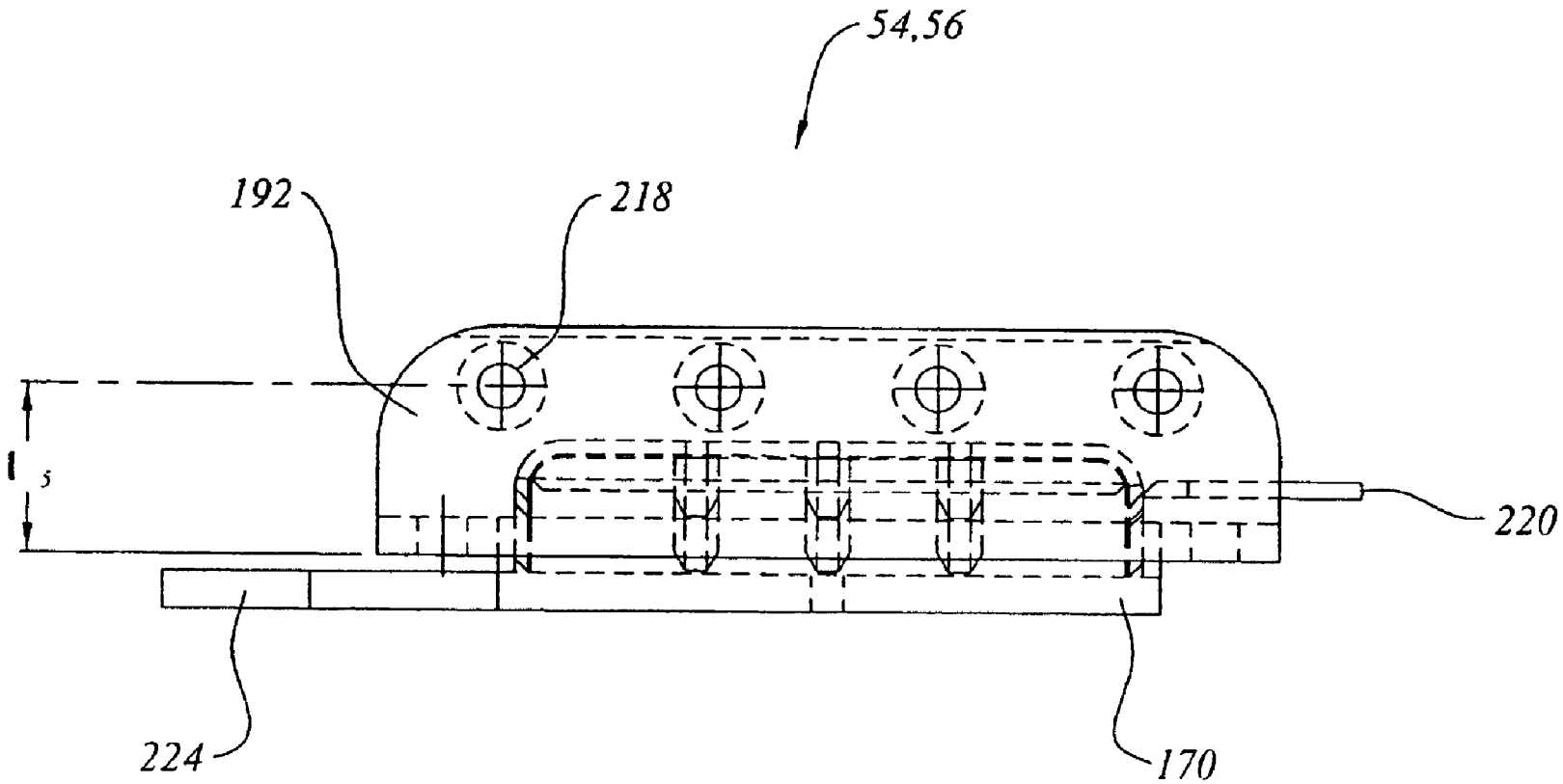
FIG. 11 shows an end view of the end cross member of FIG. 9.
Figure 12:
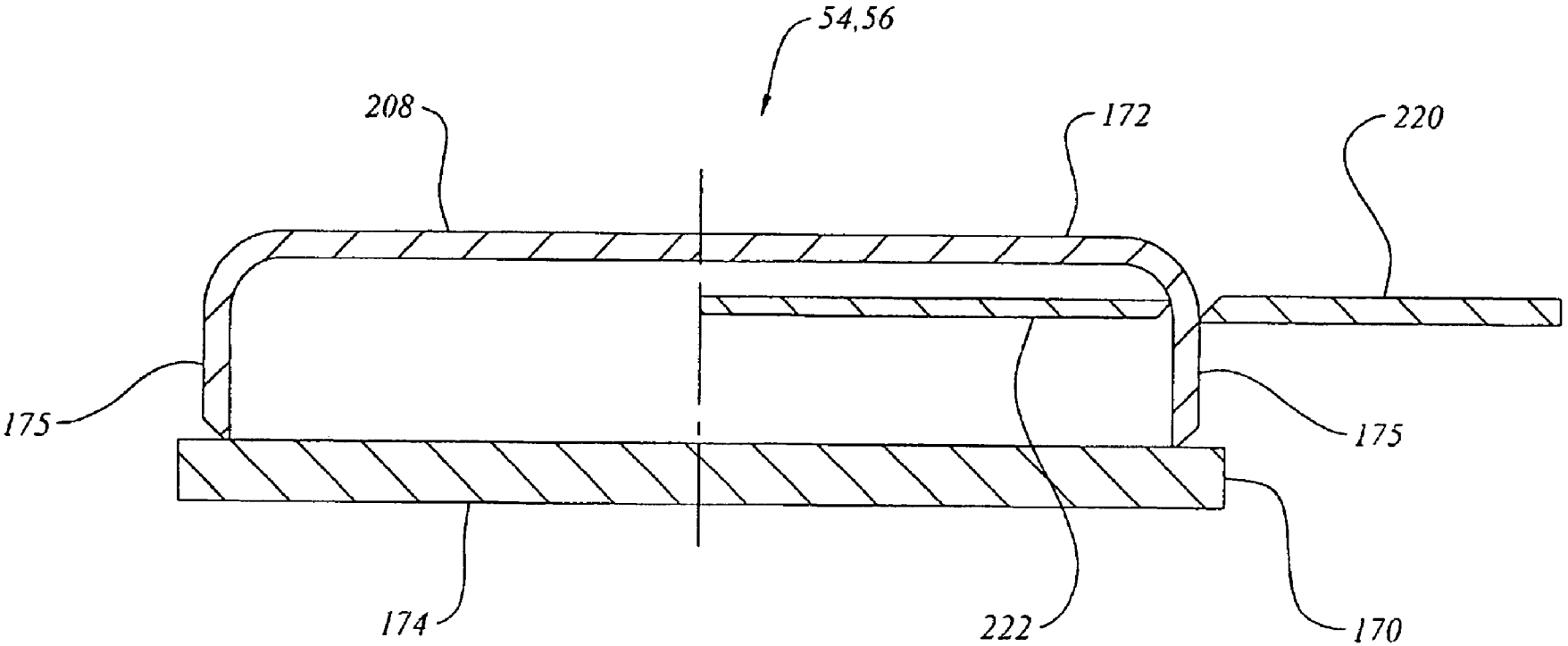
FIG. 12 shows a cross-sectional view of the end cross member taken on '12-12' of FIG. 10*a;*
Figure 13:
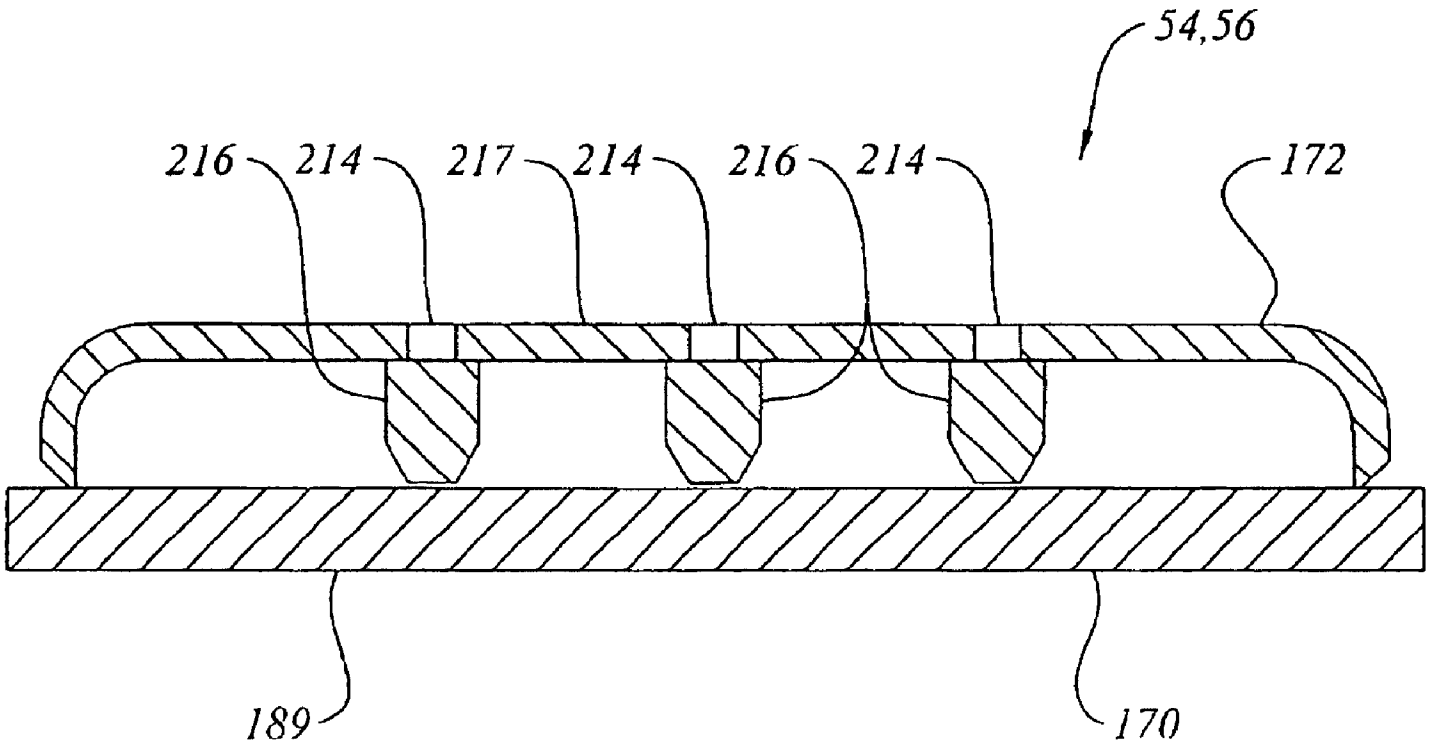
FIG. 13 shows a partial cross-sectional view of the end cross member taken on '13-13' of FIG. 10*a;*
Figure 14:
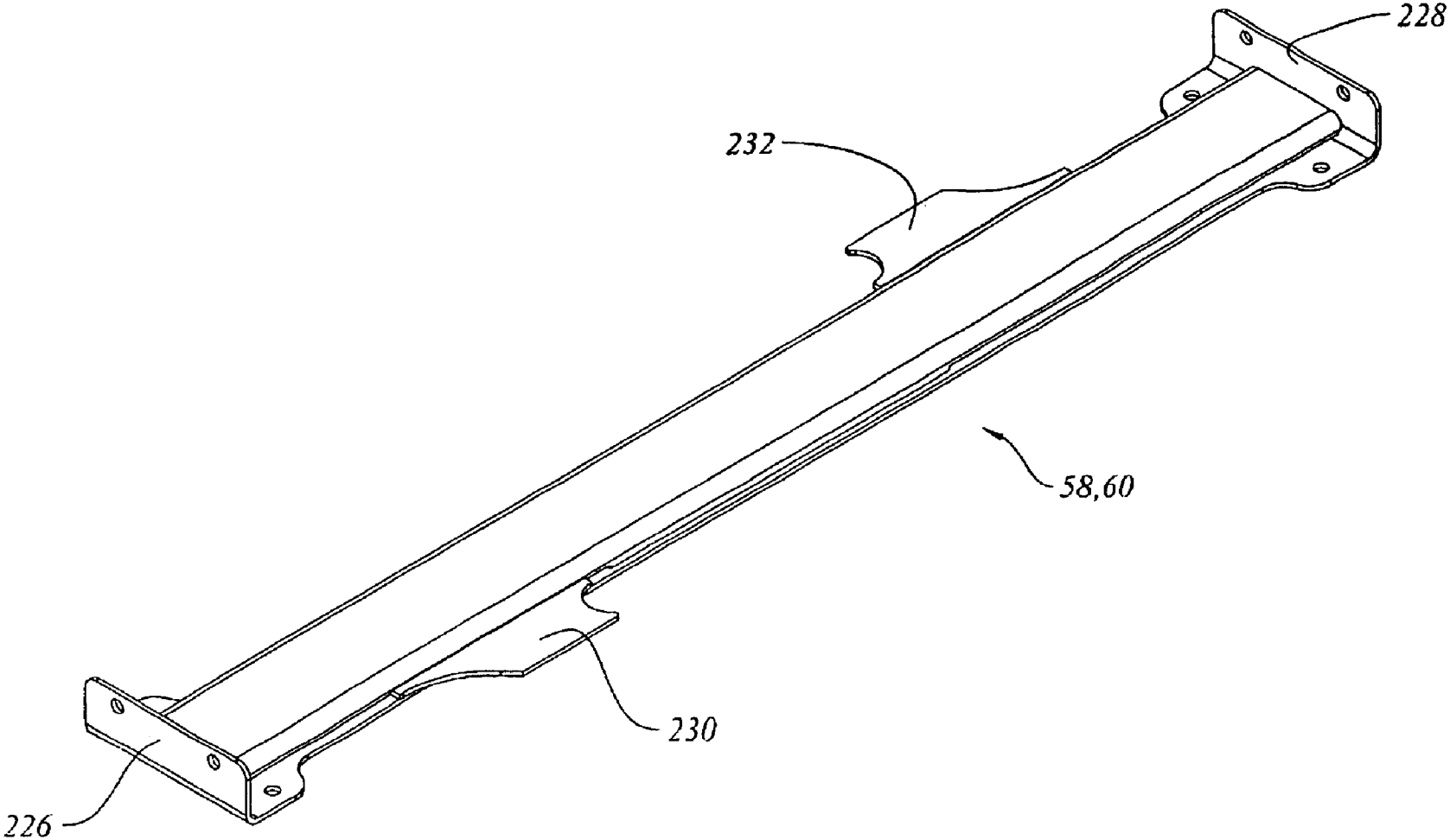
FIG. 14 shows a perspective view of the intermediate cross member of FIG. 1*a;*
Figure 15A:
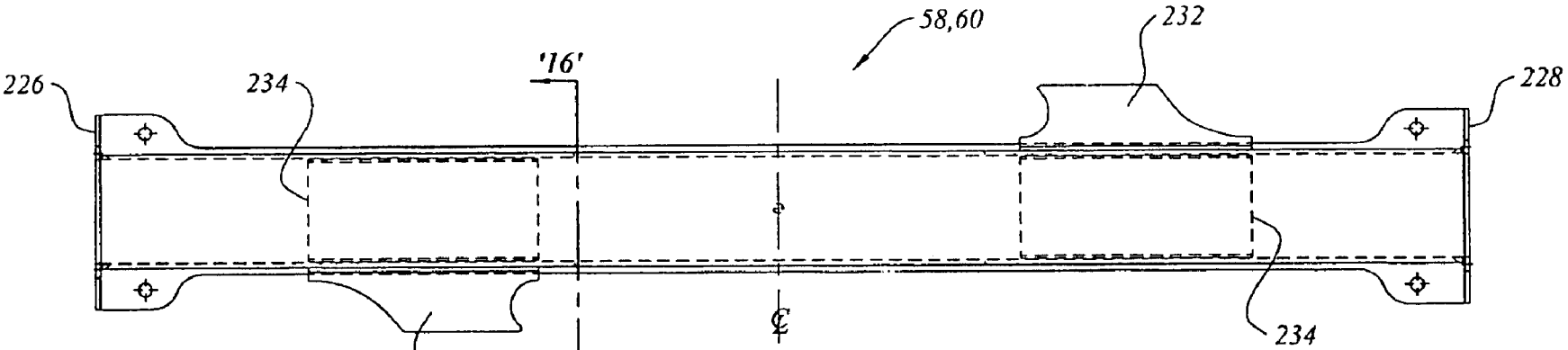
FIG. 15*a* shows atop view of the intermediate cross member of FIG. 1*a;*
Figure 15B:
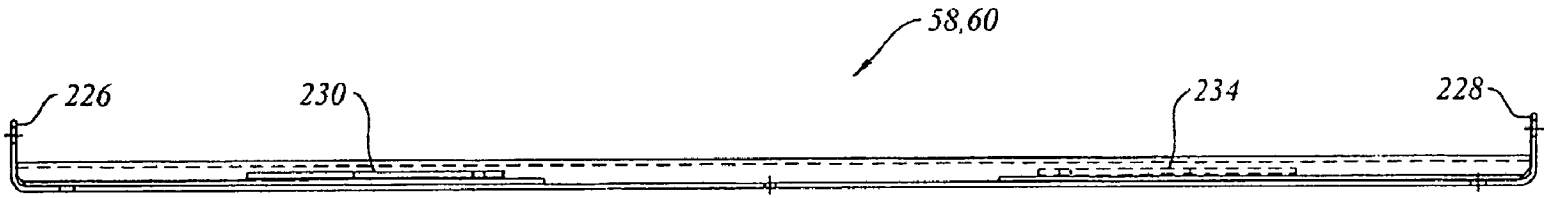
FIG. 15*b* shows a side view of the intermediate cross member of FIG. 15*a;*
Figure 15C:
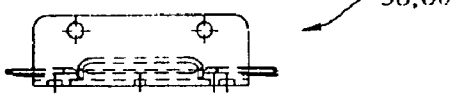
FIG. 15*c* shows an end view of the intermediate cross member of FIG. 15*a;*
Figure 16:
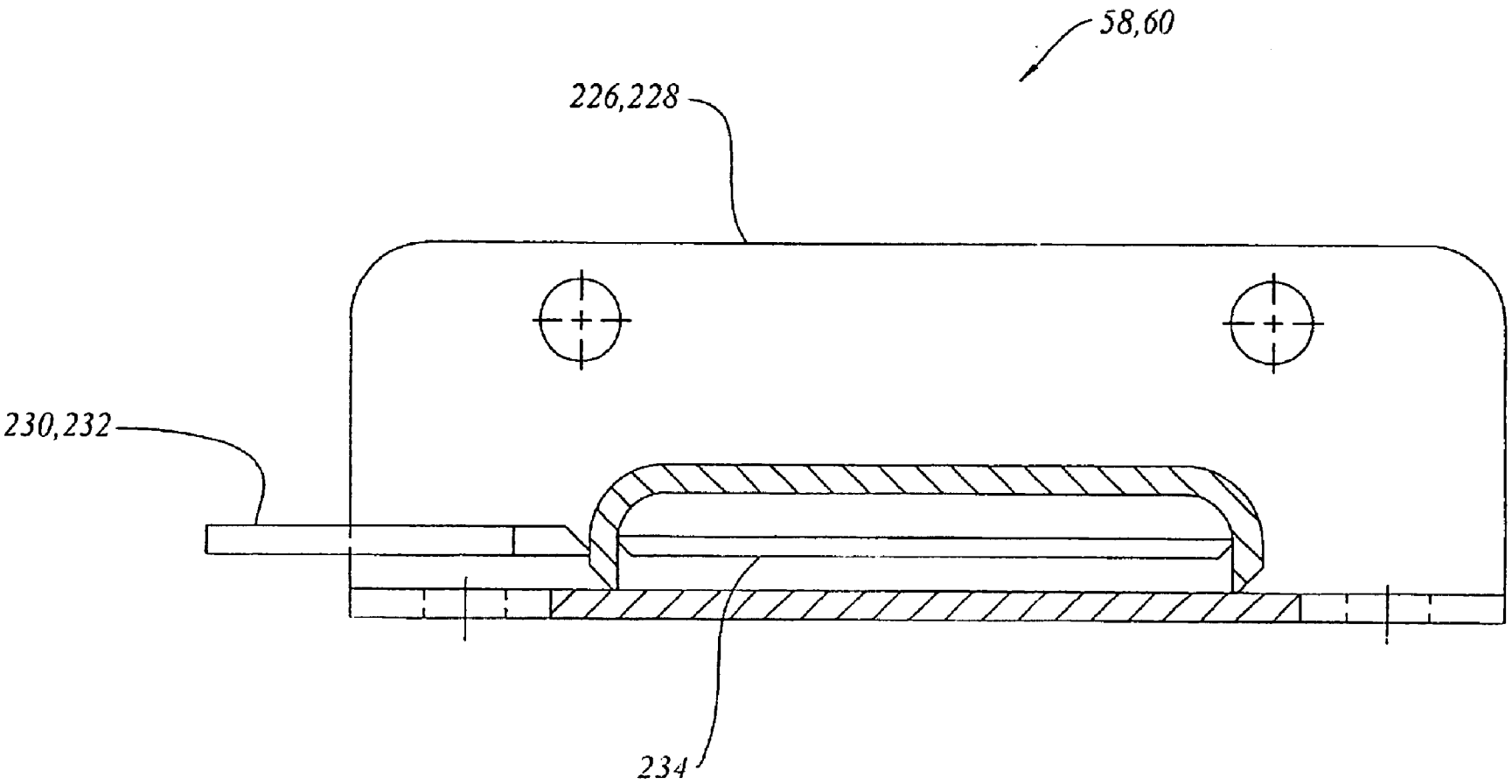
FIG. 16 shows a cross-sectional view of the intermediate cross member taken on '16-16' of FIG. 15*a;*

Similarly in the case of 40 foot cross beam 54 or 56, the bolted connection includes a set of four bolts inserted through bores 218 lying at a distance (that is, a vertical offset distance measured from the line of centers of the bolts) from the line of intersection of the planes by first distance $\lambda_4$, (FIG. 10*b*). The bolted connection also includes another pair of bolts inserted through bores 206 located to bolt the side flanges of cross beam 54 (or 56) to inwardly extending toe 81 of bottom chord 78, the bolts having a line of centers offset from the line of intersection of the planes a distance $\lambda_5$ (that is, a horizontal offset distance) (FIG. 10*b*).

The reinforcement of posts 104 and 106 relative to post 102, and the use of doublers 108 reflects a difference in function, (FIG. 1*b*). Posts 102 serve to discourage buckling of web 76. Posts 104 and 106 are connected to cross beams 54 and 52, respectively, by the bolted moment connection at bottom chord 78. As such, the extended top chords 70 may have a tendency to deflect inward toward each other under longitudinal compressive loads, the bending moment so induced will tend to be transmitted through the bolted connection and into cross beams 52 and 54, 56. Cross beams 52 and 54, 56, being of significant section, will tend to resist this bending moment, such that the entire assembly of cross beam 52, and side posts 106 and doubler 108 (or, alternatively, cross beam 54 or 56 and side posts 104 and doublers 108) acts as a U-shaped spring operable to resist, or control, lateral deflection of the top chords under longitudinal compressive (i.e., buckling) loads applied to the ends of the car, (FIG. 4*a*).

When rail car 20 is under a combined end-wise compressive load and vertical container loads, side beams 42, 44 are compressed longitudinally and tend to act as eccentrically loaded columns. As a result, top chords 70 may have a tendency to want to buckle under the load. In buckling, the side beams 42, 44 may tend to want to twist, or rotate, as indicated in FIG. 4*a*, and top chord 70 may tend to deflect laterally inboard relative to well 40 of railcar 20. This deflection may tend also to be accompanied by deflection of connected web 76, and side posts 104 and 106. Cross members 52, 54, and 56 are rigidly connected to bottom chords 78, webs 76, and doubler plates 108 abreast of posts 104 and 106 respectively to form a moment connection to each of the side beams 42, 44, and by connection, the top chords 70. The cross members 52, 54 and 56 are connected to corresponding center reinforced side posts 106 and end reinforced side posts 104, respectively. This rigid structure permits the cross members 52, 54 and 56 to carry a bending moment between side beams 42, 44.

In the configuration described above, the cross members 52, 54 and 56 work in co-operation with posts 106 and 104 respectively, to act as resilient u-shaped biasing members, or springs tending to resist lateral deflection of the top chords 70 and to resist local twisting, or rotation, of the side beams 42, 44 about an axis parallel to the longitudinal axis of the railcar 20.

In the alternate embodiment, additional end cross beams (not shown) may be placed between side beams 42 and 44 to accommodate domestic containers sizes in addition to ISO container sizes. The additional cross beams can be each located between centre cross beam 52 and an end cross beam 54, 56. In this configuration, the unequal pitch of the cross members is such that well structure 40 can accommodate, as above, either two ISO 20 foot containers, a single 40 foot ISO container, a single 45 foot domestic container or a single 48 foot domestic container. Depending on the configuration of the container carried in well structure 40, rail car 20 is also designed to support an upper, stacked 40 foot ISO container, or single stacked 45 foot, 48 foot or 53 foot domestic containers.

Figures 17A, 17B, 17C:
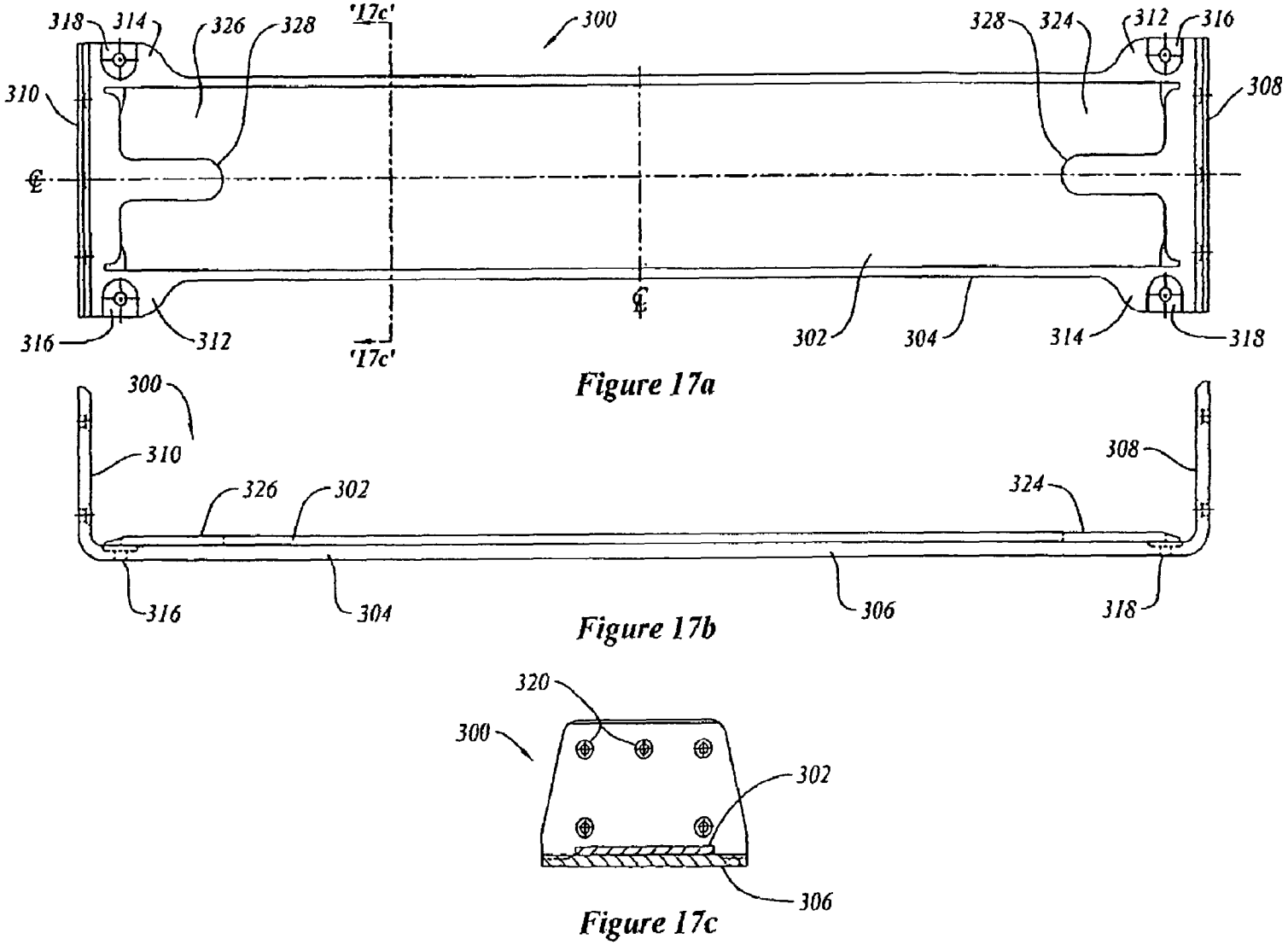
FIG. 17*a*, shows a top view of further alternative embodiment of an intermediate cross member.
FIG. 17*b*, shows a side view of the cross member of FIG. 17*a;*
FIG. 17*c*, shows an end view of the cross member of FIG. 17*a;*

FIGS. 17*a*, 17*b* and 17*c*, show an alternative embodiment in which a center cross member 300 has the form of a laminate, having a first, monolithic bridging member 304 and a reinforcing member in the nature of a plate 302 welded to the upper surface of bridging member 304. Bridging member 304 has substantially the same configuration as described above for center cross-member 52, being a plate of consistent thickness having a central spanning portion 306 bounded by widened, formed ends identified as attachment fittings 308 and 310, by which to make bolted connections to side beams 42, 44, in the manner described above. Each attachment fitting 308 or 310, is a formed, bent toe having a horizontal portion that is wider than spanning portion 306, and that merges smoothly into spanning portion 306. The wide horizontal portion has ears, or lugs, 312, 314 and counter sunk bores 316, 318 by which vertically oriented bolts can attach bridging member 304 to the inwardly extending toe of the bottom chord of either side beam. The upwardly bent toes have an array of counter sunk bolt holes 320, by which horizontally oriented bolts can attach bridging member 304 to side beams 42, 44 in the same manner as cross member 52, described above. The footprint of bolt holes 320 and bores 316, 318 is interchangeable with that of member 52 described above.

In this embodiment, the upturned toes are of roughly equal thickness to spanning portion 306, less a machining allowance for providing faces contacting side beams 42, or 44, as opposed to being machined down from a much greater thickness, as in cross-member 52. Machining of the sides of the bent portion may be employed, as above, to reduce the tendency to provide fatigue crack initiation sites. Alternatively, if machining is required, the amount of material to be removed is significantly reduced by starting with a thinner member. Further, the forming of a thinner member is generally easier than the forming of a thicker member.

Plate 302 is welded to bridging member 304, to form a two layered laminate. More than two layers can be used if desired. The combined thickness of bridging member 304 and plate 302 is comparable to the through thickness of the spanning portion of cross member 52. For example, in one embodiment the bridging member may be at least 1 inch thick and the plate 302 may be ⅝ of an inch thick or more. The ends of plate 302 provide flat surfaces 324, 326 upon which the corners of 20 foot containers can seat.

While plate 302 may be connected to either surface of longitudinal portion 306, it is preferably connected to the side of the member closest to the lading. In this configuration, plate 302 may protect bridging member 304 when lading is placed thereon. Plate 302 substantially covers the entire longitudinal portion 306, and may be thinner than the bridging member 304. Welding about the perimeter of plate 302 may be used to connect the plate 302 to the bridging member 304. The plate may have a rebate 328 at an end, wherein the rebate 328 extends along the longitudinal centerline of the plate 302. The periphery of rebate 328 provides a serpentine weld path, the weld being predominantly in shear.

Plate 302 can be made of a higher yielding material than might otherwise be used, and need not be of the same yield strength as bridging member 304. For example, steel of 50 ksi yield is commonly used for formed parts, such as bridging member 304, whereas a flat plate, such as plate 302, can be of a different yield, such as of 60 or 70 ksi, or higher, yield. Furthermore, lamination of plate 302 and bridging member 304 can be made to give a residual tensile stress in plate 302, and a residual compressive stress in the spanning portion of bridging member 304.

While the application of a laminate to a center cross member has been described, a laminate may also be applied to strengthen and/or protect any of the other members 52, 54, 56, 58, 60 or the cross braces 61 to 64 in a similar manner.

Various modifications of detail may be made to the preferred embodiment, and other embodiments, discussed and illustrated herein, without departing from the spirit and scope of the present invention as defined by the following claims.

What is claimed is:

1. A cross-member for a rail road well car for carrying shipping containers, said cross-member comprising:

a monolithic beam member having a first end portion for mounting to a first side beam of the well car, a second end portion for mounting to a second side beam of the well car, and a spanning portion extending between said first and second end portions; and, a retractable container stop mounted to said monolithic beam member;

said retractable stop being movable between a first, retracted, position and a second, extended, position; and in said extended position said stop standing proud of said monolithic beam member to obstruct the passage of shipping containers.

2. The cross-member of claim 1 further comprising two of said stops spaced apart on said monolithic member.

3. The cross-member of claim 1 wherein said stops are located at either end of said beam member.

4. The cross-member of claim 2 wherein each of said container stops is biased to their respective extended positions.

5. The cross-member of claim 1 wherein said cross member has a socket formed therein, and said retractable container stop is mounted in said socket.

6. The cross-member of claim 1 wherein said cross-member is wider adjacent said retractable container stop than elsewhere.

7. The cross-member of claim 1 wherein said beam member has an upwardly facing load bearing surface extending longitudinally to either side of said retractable container stop, said container stop is movable to said retracted position under the vertical load of a container, and, in said retracted position, said stop permits shifting of containers relative thereto.

8. The cross-member of claim 1 wherein said beam member has a load bearing surface, and said retracted position is chosen from the set of retracted positions consisting of (a) a position that is flush with said load bearing surface; and (b) a position that is shy of said load bearing surface.

9. The cross-member of claim 8 wherein said stop is a round cylindrical stop, said beam member has a bore formed therein, and said round cylindrical stop is matingly engaged in said bore.

10. The cross-member of claim 8 wherein said stop has planar abutment surfaces for installation facing longitudinally forward and rearward relative to the well car, and said beam member has a bore formed therein for mating engagement of said stop.

11. The cross-member of claim 1 wherein said first and second end portions each have a toe bent to form an upstanding flange.

12. The cross-member of claim 11 wherein each of the upstanding flanges of said first and second end portions has respective mounting fittings formed therein.

13. The cross-member of claim 12 wherein each of said first and second end portions has a horizontal portion, and fittings formed in said horizontal portion for attaching said horizontal portion to a horizontal portion of the respective side beams of the rail road car.

14. The cross-member of claim 1 wherein said spanning portion has a first vertical through thickness, said first end portion has a second vertical through thickness, and said second vertical through thickness is smaller than said first vertical through thickness.

15. The cross-member of claim 14 wherein said first end portion includes a toe bent upwardly to form an upstanding flange, and said flange is machined to have a diminishing thickness.

16. The cross-member of claim 1 wherein said cross member has at least one lightening aperture formed therein.

17. A cross-member for a rail road well car for carrying shipping containers, said cross member comprising:

a monolithic beam member having a first end portion for mounting to a first side beam of the well car, a second end portion for mounting to a second side beam of the well car, and a spanning portion extending between said first and second end portions; and, a stop means for obstructing the motion of shipping containers, said stop means being mounted to said monolithic beam member;

said stop means being movable between a first, retracted, position and a second, extended, position;

in said extended position said stop means standing proud of said monolithic beam member to obstruct the passage of shipping containers.

18. The cross-member of claim 17 comprising two of said stop means mounted to said monolithic beam member.

19. The cross-member of claim 17 wherein said stop means is biased to a container obstructing position.

20. The cross-member of claim 17 wherein said stop means includes a block means movably mounted in a socket means.

21. The cross member of claim 17 wherein said beam member has an upwardly facing container load bearing means, and said stop means is mounted longitudinally amidst said container load bearing means, and, in said retracted position, said stop means permits shifting of containers relative thereto.

22. The cross-member of claim 17 wherein said beam member has an upwardly facing load bearing means, and said retracted position of said stop means is chosen from the set of retracted positions consisting of (a) a position that is flush with said load bearing means; and (b) a position that is shy of said load bearing means.

23. A rail road well car comprising:

a pair of end structures supported by rail road car trucks for rolling along railroad tracks, and a pair of spaced apart side beams extending lengthwise between said end structures, said side beams and said end structures defining a well therebetween, said well having at least three cross-members mounted therein, said cross-members extending between said side beams and providing support for containers carried in said well;

a first of said cross-members being a first end cross-member;

a second of said cross-members being a second end cross-member;

a third of said cross-beams being located intermediate said first and second cross-members;

said third cross-member including a monolithic beam member having a first end portion for mounting to a first one of said side beams of the well car, a second end portion for mounting to a second one of said side beams of the well car, and a spanning portion extending between said first and second end portions; and, at least one retractable container stop mounted to said monolithic beam member;

said retractable stop being movable between a first, retracted, position and a second, extended, position;

in said extended position said stop standing proud of said monolithic beam member to obstruct the passage of shipping containers.

24. The rail road well car of claim 23 wherein the third cross-member has a surface upon which an intermodal container can sit, each said stop has a top, and, in said retracted position, said top lies flush with said surface.

25. The rail road car of claim 23 wherein:

said first and second end portions of said third cross-member include toes formed to mate with said side beams;

each said end portion has a respective upwardly facing surface for supporting an intermodal container;

each said end portion has a recess defined therein amidst said upwardly facing surface;

one of said stops is located in each of said recesses;

each said stop has a top; and, in a retracted position each said top lies flush with a respective said upwardly facing surface.

26. The rail road well car of claim 23 wherein:

each of said side beams has a top chord, a bottom chord, and an intermediate member extending between and joining said top chord and said bottom chord;

each of said bottom chords has an upwardly extending leg and a transverse leg, said transverse legs extending toward each other;

said third cross-member has first and second end portions:

each of said first and second end portions of said third cross-member has a horizontally extending portion, said horizontally extending portion having bores formed therein to permit said horizontally extending portion to be bolted to the respective transverse leg of one of said respective bottom chords;

each of said first an second end portions of said third cross-member has an upwardly extending flange adjacent said upwardly extending leg of said respective bottom chord, said upwardly extending flanges being bolted to a respective one of said first and second side beams.

27. The rail road well car of claim 23 wherein:

each of said side beams has a bottom chord;

each said bottom chord has a transversely inwardly extending leg;

said transversely inwardly extending legs extending toward each other and leaving a gap therebetween that is less than 8'0" wide;

said bottom chords meet said first and second end portions of said third cross-member at respective first and second junctions, and said transversely inwardly extending legs of said bottom chords each have a relief means formed thereon adjacent said first and second junctions.

28. The railroad well car of claim 27 wherein said relief means accommodates motion of said stop.

* * * * *